US007493839B2

(12) United States Patent
Massari, Jr. et al.

(10) Patent No.: US 7,493,839 B2
(45) Date of Patent: Feb. 24, 2009

(54) PORTABLE SCREW DRIVING TOOL WITH COLLAPSIBLE FRONT END

(75) Inventors: Donald J. Massari, Jr., Cincinnati, OH (US); Michael R. Desmond, Newport, KY (US); William H. Hoffman, Cincinnati, OH (US)

(73) Assignee: Duraspin Products LLC, Cincinnati, OH (US)

( * ) Notice: Subject to any disclaimer, the term of this patent is extended or adjusted under 35 U.S.C. 154(b) by 118 days.

(21) Appl. No.: 11/359,943

(22) Filed: Feb. 22, 2006

(65) Prior Publication Data

US 2006/0191385 A1 Aug. 31, 2006

Related U.S. Application Data

(60) Provisional application No. 60/656,346, filed on Feb. 25, 2005.

(51) Int. Cl.
*B25B 23/04* (2006.01)
*B25B 21/00* (2006.01)

(52) U.S. Cl. ..... 81/434; 81/57.13

(58) Field of Classification Search ..... 81/57.37, 81/430, 433–435; 227/135, 136, 138
See application file for complete search history.

(56) References Cited

U.S. PATENT DOCUMENTS 4,014,488 A 3/1977 Potucek et al.
4,062,388 A * 12/1977 DeCaro ..... 81/57.37
4,397,412 A * 8/1983 Dewey ..... 81/57.37
4,404,877 A 9/1983 Mizuno et al.
4,428,261 A * 1/1984 Takatsu et al. ..... 81/434
4,774,863 A 10/1988 Geist
5,083,483 A 1/1992 Takagi
5,109,738 A 5/1992 Farian et al.
5,134,909 A 8/1992 Sasaki
5,167,174 A 12/1992 Fujiyama et al.

(Continued)

FOREIGN PATENT DOCUMENTS

AU 27254/77 1/1979

(Continued)

OTHER PUBLICATIONS

International Search Report of PCT/US2006/006185, 12 pages (Nov. 22, 2006).

(Continued)

*Primary Examiner*—Hadi Shakeri
(74) *Attorney, Agent, or Firm*—Frederick H. Gribbell

(57) ABSTRACT

A portable hand-held screw driving tool is provided for use with collated strips of screws. The front portion of the tool is movable to a great extent, to thereby allow the tool to drive screws almost directly at the corner of two walls. A front "nose piece" is pressed against one of the walls, which causes the nose piece to move rearward "into" the remainder of the tool, in a "first stage" of movement. A screw is indexed to its drive position, and a drive bit is abutted against the screw head during this first stage. The nose piece is pressed further into the tool, which also causes a "feed tube" to move rearward "into" the remainder of the tool, in a "second stage" of movement, which rotates the screw as it is emplaced into the wall.

20 Claims, 26 Drawing Sheets

U.S. PATENT DOCUMENTS

| | | | | |
|---|---|---|---|---|
| 5,219,110 | A | 6/1993 | Mukoyama | |
| 5,238,168 | A | 8/1993 | Oda | |
| 5,267,682 | A | 12/1993 | Okouchi | |
| 5,322,189 | A | 6/1994 | Oda | |
| 5,337,636 | A | 8/1994 | Shea | |
| 5,339,713 | A * | 8/1994 | Hou | 81/434 |
| D358,749 | S | 5/1995 | Matsunaga et al. | |
| 5,473,965 | A | 12/1995 | Chen | |
| D368,216 | S | 3/1996 | Hattori | |
| 5,687,624 | A | 11/1997 | Tsuge et al. | |
| 5,799,856 | A | 9/1998 | Mukoyama | |
| 5,810,239 | A | 9/1998 | Stich | |
| 5,855,151 | A * | 1/1999 | Habermehl | 81/434 |
| 5,904,079 | A | 5/1999 | Tsuge et al. | |
| 5,947,210 | A | 9/1999 | Sasaki et al. | |
| 5,988,026 | A | 11/1999 | Reckelhoff et al. | |
| 6,016,946 | A | 1/2000 | Phillips et al. | |
| D420,877 | S | 2/2000 | Schultz | |
| D420,879 | S | 2/2000 | Watson et al. | |
| 6,045,024 | A | 4/2000 | Phillips | |
| 6,089,331 | A | 7/2000 | Christ et al. | |
| 6,158,643 | A | 12/2000 | Phillips | |
| D436,511 | S | 1/2001 | Hayakawa | |
| 6,179,192 | B1 | 1/2001 | Weinger et al. | |
| D438,079 | S | 2/2001 | Hattori | |
| D462,001 | S | 8/2002 | Bohart et al. | |
| 6,523,658 | B2 | 2/2003 | Furuta et al. | |
| 6,536,537 | B1 | 3/2003 | Sasaki et al. | |
| 7,104,433 | B2 * | 9/2006 | Fujiyama | 81/434 |
| 2002/0100347 | A1 | 8/2002 | Daubinger et al. | |

FOREIGN PATENT DOCUMENTS

| | | | |
|---|---|---|---|
| DE | 41 19 925 | | 1/1992 |
| DE | 42 08 715 | | 9/1992 |
| DE | 195 26 543 | | 1/1996 |
| EP | 0 058 986 | | 9/1982 |
| EP | 0 623 426 | | 11/1994 |
| EP | 0 623 426 | A1 | 11/1994 |
| GB | 2 092 495 | A | 8/1982 |
| GB | 2 396 131 | A | 6/2004 |
| WO | WO99/59756 | | 11/1999 |

OTHER PUBLICATIONS

International Preliminary Report on Patentability, PCT/US2006/006185, 8 pages (Sep. 7, 2007).
Sales brochure of Senco Products, Inc, 2 pages (2002).
International Search Report, PCT/US2005/020883, 15 pages (Jun. 13, 2005).

* cited by examiner

PORTABLE SCREW DRIVING TOOL WITH COLLAPSIBLE FRONT END

CROSS-REFERENCE TO RELATED APPLICATIONS

The present application claims priority to provisional patent application Ser. No. 60/656,346, titled "PORTABLE SCREW DRIVING TOOL WITH COLLAPSIBLE FRONT END," filed on Feb. 25, 2005.

TECHNICAL FIELD

The present invention relates generally to portable electrical tools and is particularly directed to a screw driving tool of the type which receives a collated flexible strip or belt that contains individual screws, and drives the individual screws into solid objects. The invention is specifically disclosed as a screw driving tool with a collapsible front end to provide the capability to drive screws almost directly into corners of walls. The invention includes two main configurations, the first of which is an integral fastener driving tool, and the second of which is an attachment that can be mounted to the front end of a conventional screw gun.

BACKGROUND OF THE INVENTION

Portable hand-held screw driving tools have been available from Senco Products, Inc. and DuraSpin Products LLC for several years. These tools typically include a movable front end that was essentially depressed into the remaining portion of the tool by pressing the front end of the tool against a solid object that will receive the screw. The movable portion of the previous tools has been referred to as a movable "nose piece," which also had a slide body sub-assembly that is fixedly attached to the nose piece, thereby moving the slide body sub-assembly at the same time the nose piece moved, relative to the housing of the tool. As the nose piece and slide body sub-assembly move, a screw is indexed to a drive position, the head of the screw is engaged against the front end of a drive bit, and later the drive bit is rotated to cause the screw to rotate while it is emplaced into the solid object.

The initial movement of the tool could be referred to as a first stage of movement, during which the screw is indexed to the drive position (note that this is for an indexed on advance arrangement), and the drive bit is engaged within the slot or recess of the screw head. During the first stage, the drive bit is not intentionally rotated to any significant amount, perhaps only a small amount so as to ensure its proper alignment into the slot or recess of the screw's head. Then during a second stage of movement, the motor inside the portable tool is energized, and the drive bit is then rotated to drive the screw into the object.

In the previous Senco/DuraSpin tools, these two stages of movement caused the nose piece with slide body sub-assembly to linearly "collapse" into a "feed tube" that itself was fixedly attached to the housing of the portable tool. Since the feed tube was not movable with respect to the housing, the feed tube itself had a dimension that would contact a surface of a wall when the tool was used to drive a screw near the corner of two adjoining walls. The distal (i.e., front) end of the feed tube and the distal (or front) end of the housing were the primary constraints on locating a screw as close to the corner as possible.

SUMMARY OF THE INVENTION

Accordingly, it is an advantage of the present invention to provide a portable hand-held screw driving tool that has a collapsible front end that allows the screw driving tool to drive a screw into a corner of two adjoining walls at a position more nearly at the exact corner.

It is another advantage of the present invention to provide a portable hand-held screw driving tool that has a movable feed tube that allows the movable nose piece as well as the movable feed tube to "collapse" into the fixed housing area of the tool, and essentially allow the tool to be placed much closer to the exact corner of two walls.

It is a further advantage of the present invention to provide a portable hand-held attachment for use with a separate screw driving gun, in which the attachment has a movable feed tube that allows its movable nosepiece as well as the movable feed tube to "collapse" into a fixed housing of the attachment, and essentially it allows the attachment to place a screw much closer to the exact corner of two walls.

Additional advantages and other novel features of the invention will be set forth in part in the description that follows and in part will become apparent to those skilled in the art upon examination of the following or may be learned with the practice of the invention.

To achieve the foregoing and other advantages, and in accordance with one aspect of the present invention, a portable fastener-driving tool is provided, which comprises: (a) an elongated housing containing a prime mover device, the housing having a first end and a second end; (b) a first member extending from the first end of the housing, the first member having a third end and a fourth end, in a first, non-actuated state the third end being distal from the first end of the housing and the fourth end being proximal to the first end of the housing; (c) a second member extending from the third end of the first member, the second member having a fifth end and a sixth end, in the first, non-actuated state the fifth end being distal from the third end of the first member and the sixth end being proximal to the third end of the first member; (d) an intermediate drive device that extends between the prime mover device and the second member; wherein: (e) the first member is movable with respect to the housing; (f) the second member is movable with respect to the first member; (g) when in the first, non-actuated state, the first member extends past the first end of the housing such that the third end of the first member is positioned substantially at a first predetermined distance from the first end of the housing, and the second member extends past the third end of the first member such that the fifth end of the second member is positioned substantially at a second predetermined distance from the third end of the first member; (h) when in a second state, as the second member is pushed against a solid object, the first member continues to extend past the first end of the housing substantially at the first predetermined distance between the first end of the housing and the third end of the first member, but the second member moves toward the housing and the first member, such that the fifth end of the second member becomes positioned from the third end of the first member at a distance less than the second predetermined distance; and (i) when in an third state, as the second member continues to be pushed against the solid object, both the second member and the first member move toward the housing, such that the third end of the first member becomes positioned from the first end of the housing at a distance less than the first predetermined distance.

In accordance with another aspect of the present invention, a portable fastener-driving tool is provided, which comprises: (a) a housing containing a prime mover device and an intermediate drive device, the housing having an actuation end; (b) a movable first member extending from the actuation end of the housing, the first member having a first distal end; (c) a movable second member extending from the first distal end of the first member, the second member having a second distal end; wherein: (d) in a first, non-actuated state, the second distal end of the second member is substantially at a predetermined first distance with respect to the actuation end of the housing; and (e) when the tool is actuated by a sufficient force against the second distal end of the second member, the second member begins to move relative to the housing, and: (1) the second member travels through a first stage of movement from the predetermined first distance, and moves relative to the first member, while the first member is substantially prevented by a first mechanism from moving relative to the housing until the second distal end of the second member reaches substantially a predetermined second distance with respect to the actuation end of the housing; and (2) then the second member travels through a second stage of movement from the predetermined first distance and past the predetermined second distance, and the first member moves relative to the housing while overcoming the first mechanism, until the second distal end of the second member reaches substantially a predetermined third distance with respect to the actuation end of the housing, which substantially completes the movement of the second member; wherein the predetermined first distance is greater than the predetermined second distance, and the predetermined second distance is greater than the predetermined third distance.

In accordance with yet another aspect of the present invention, a portable fastener-driving tool is provided, which comprises: (a) a housing containing a prime mover device, the housing having an actuation end; (b) a movable first member extending from the actuation end of the housing, the first member having a first distal end; (c) a movable second member extending from the first distal end of the first member, the second member having a second distal end; (d) a first spring device that tends to oppose movement between the first member and the housing; (e) a second spring device that tends to oppose movement between the second member and the first member; wherein, when the tool is actuated by a sufficient force against the second distal end of the second member: (f) during a first stage of actuation, the second member moves relative to the first member, while being opposed by the second spring device, but the first member does not substantially move relative to the housing due to the first spring device; and (g) during a second stage of actuation, the first member moves relative to the housing, while being opposed by the first spring device.

In accordance with a further aspect of the present invention, an attachment for a separate portable fastener-driving tool is provided, which comprises: (a) a housing containing an open interior space for allowing an external drive device to pass therethrough, said housing having a mating end that allows it to mount to a separate portable fastener-driving tool, and said housing having an actuation end; (b) a movable first member extending from said actuation end of the housing, said first member having a first distal end; and (c) a movable second member extending from said first distal end of the first member, said second member having a second distal end; wherein: (d) in a first, non-actuated state, said second distal end of the second member is substantially at a predetermined first distance with respect to said actuation end of the housing; and (e) when said second distal end of the second member is pressed against an external surface, said second member begins to move relative to said housing, and: (1) said second member travels through a first stage of movement from said predetermined first distance, and moves relative to said first member, while said first member is substantially prevented by a first mechanism from moving relative to said housing until said second distal end of the second member reaches substantially a predetermined second distance with respect to said actuation end of the housing; and (2) then said second member travels through a second stage of movement from said predetermined first distance and past said predetermined second distance, and said first member moves relative to said housing while overcoming said first mechanism, until said second distal end of the second member reaches substantially a predetermined third distance with respect to said actuation end of the housing, which substantially completes the movement of said second member; wherein said predetermined first distance is greater than said predetermined second distance, and said predetermined second distance is greater than said predetermined third distance.

In accordance with a yet further aspect of the present invention a portable fastener-driving tool is provided, which comprises: (a) a housing containing a prime mover device and an intermediate drive device, the housing having an actuation end; (b) a movable first member extending from the actuation end of the housing, the first member having a first distal end; and (c) a movable second member extending from the first distal end of the first member, the second member having a second distal end; wherein: (d) in a first, non-actuated state, the second distal end of the second member is substantially at a predetermined first distance with respect to the actuation end of the housing, and the first distal end of the first member is substantially at an initial position with respect to the actuation end of the housing; (e) when the tool is actuated by a sufficient force against the second distal end of the second member, the second member moves relative to the housing, the first member moves relative to the housing, and the second member is not prevented from moving with respect to the first member; during these movements, the second distal end reaches substantially a predetermined second distance with respect to the actuation end of the housing, which substantially completes the movement of the second member toward the housing, wherein the predetermined first distance is greater than the predetermined second distance; and (f) after the tool has been fully actuated such that the second distal end of the second member has reached substantially the predetermined second distance with respect to the actuation end of the housing, the force against the second distal end of the second member is removed: (1) then the second member moves relative to the housing such that its second distal end moves away from the actuation end of the housing, while traveling through a first stage of movement from the predetermined second distance toward the predetermined first distance, and the first member also moves relative to the housing such that its first distal end moves away from the actuation end of the housing until the first distal end of the first member arrives substantially at a predetermined third distance from the actuation end of the housing, and then the first member is prevented by a first mechanism from moving substantially further away from the housing; and (2) then the second member continues to moves relative to the housing such that its second distal end moves further away from the actuation end of the housing while traveling through a second stage of movement, until its second distal end reaches substantially the predetermined first distance from the actuation end of the housing, which substantially completes the movement of the second member away from the housing; wherein: (A) the first member continues to be prevented by the first mechanism from moving further away from the housing substantially past the predetermined third distance; and (B) the predetermined first distance is greater than the predetermined third distance, and the predetermined third distance is greater than the predetermined second distance.

In accordance with a still further aspect of the present invention, a portable fastener-driving tool is provided, which comprises: (a) a housing containing a prime mover device and an intermediate drive device, the housing having an actuation end; (b) a movable first member extending from the actuation end of the housing, the first member having a first distal end; and (c) a movable second member extending from the first distal end of the first member, the second member having a second distal end, the second member including a fastener indexing mechanism that operates with a collated strip of fasteners; (d) the intermediate drive device including a drive bit that extends toward the fastener indexing mechanism; wherein: (e) in a first, non-actuated state, the second distal end of the second member is substantially at a predetermined first distance with respect to the actuation end of the housing, and the first distal end of the first member is substantially at an initial position with respect to the actuation end of the housing; (f) when the tool is actuated by pressing the second distal end of the second member against a solid object with a sufficient force to cause the second member to be moved toward the housing: (1) the second member moves relative to the housing; (2) the first member moves relative to the housing; (3) the drive bit engages a first fastener of the collated strip of fasteners and, at the fastener indexing mechanism, separates the first fastener from the collated strip of fasteners to drive the first fastener into the solid object; (4) the second distal end reaches substantially a predetermined second distance with respect to the actuation end of the housing, which substantially completes the movement of the second member toward the housing, wherein the predetermined first distance is greater than the predetermined second distance; and (g) after the tool has been fully actuated such that the second distal end of the second member has reached substantially the predetermined second distance with respect to the actuation end of the housing, the force against the second distal end of the second member is removed: (1) then the second member moves relative to the housing such that its second distal end moves away from the actuation end of the housing, while traveling through a first stage of movement from the predetermined second distance toward the predetermined first distance, and during the first stage of movement the drive bit remains in a position that prevents the collated strip of fasteners from indexing; and (2) after the drive bit becomes clear of the collated strip of fasteners, the second member continues to move away from the actuation end of the housing while traveling through a second stage of movement toward the predetermined first distance, and a second fastener is moved into a drive position during the second stage of movement of the second member.

Still other advantages of the present invention will become apparent to those skilled in this art from the following description and drawings wherein there is described and shown a preferred embodiment of this invention in one of the best modes contemplated for carrying out the invention. As will be realized, the invention is capable of other different embodiments, and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification illustrate several aspects of the present invention, and together with the description and claims serve to explain the principles of the invention. In the drawings:

DETAILED DESCRIPTION OF THE PREFERRED EMBODIMENT

Figure 1:
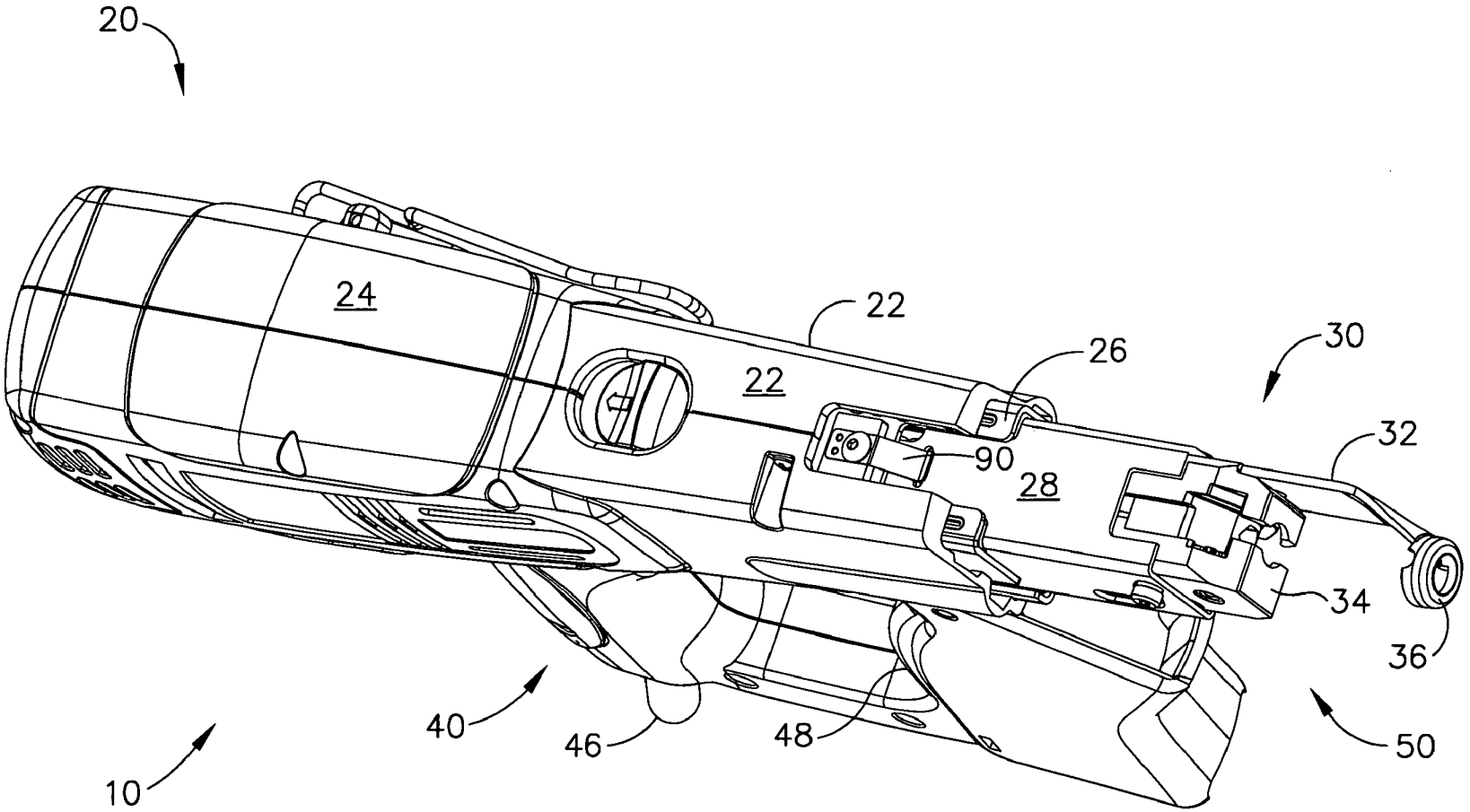
FIG. 1 is a perspective view of a fastener driving tool constructed according to the principles of the present invention, illustrated in its "free," non-actuated state.

Reference will now be made in detail to the present preferred embodiment of the invention, an example of which is illustrated in the accompanying drawings, wherein like numerals indicate the same elements throughout the views.

The present invention is a screw driving tool that loads a collated flexible strip or belt of individual screws, and drives the individual screws into solid objects. A first illustrated embodiment has a movable nose piece that is attached to a slide body sub-assembly that includes an indexing sprocket to receive the collated strip of screws, and to feed an individual screw into a drive position so that the screw can be driven into the solid object. The movable nose piece and slide body are in a mechanical slidable arrangement with a movable feed tube, which in turn is in a slidable mechanical arrangement with a fixed feed tube that is fixedly attached to the housing that contains the major components of the tool. When the front end of the nose piece is pressed against a solid object, it begins an actuation sequence in which the nose piece is essentially pushed back into the movable feed tube portion during a "first stage" of movement. During this first stage, a screw is placed into the drive position, and the slide body sub-assembly and the screw are then forced back toward a drive bit until the head of the screw abuts the drive bit. In a first mode of the invention, this ends the first stage of movement.

During a second stage of movement, the nose piece continues to be pushed back toward the remainder of the tool, and now the movable feed tube also begins to move relative to the fixed feed tube. This begins the second stage movement, which ends when the movable feed tube essentially collapses entirely into the fixed feed tube region. During this second stage movement in the first mode of the invention, the drive bit is rotated by a prime mover device, thereby rotating the screw so that it is rotatably emplaced into the solid object against which the front end of the tool abuts. In a second mode of the invention, the drive bit can begin rotating the screw as part of the first stage of movement.

At the end of the second stage of movement, the screw is entirely driven into the solid object, and the tool can be removed from the solid object. The movable feed tube is now returned to its "free" or non-actuated position by a coil spring, and also the movable nose piece along with its attached slide body sub-assembly are also moved back to their "free" or non-actuated position, by a different coil spring.

In the first illustrated embodiment, a leaf spring helps to prevent the movable feed tube from substantially moving during the first stage of movement. Once the first stage of movement is completed, the leaf spring is bumped away from a slot that it rests in, which occurs during the second stage of movement, while the movable feed tube is moving relative to the fixed feed tube.

In a second illustrated embodiment of the screw driving tool of the present invention, there is no leaf spring, and a coil spring essentially provides all of the mechanical opposition to prevent substantial movement of the movable feed tube relative to the fixed feed tube during the first stage of movement of the nose piece. A further alternative embodiment could utilize a single two-stage spring that exhibits at least two different spring rates at varying compression displacements. A yet further alternative embodiment could use a different type of latching or mechanical resistance device to oppose the motion of the movable feed tube relative to the fixed feed tube during the first stage of movement, or perhaps an opposing or resisting device that works on a different principle of operation, such as pneumatics, hydraulics, or electricity. For example, a vacuum resisting and return device, or a compressed air resisting and return device could be used, or a combination of a mechanical resisting element and a pneumatic return element could be used. Or, for example, an electromagnetic device such as a solenoid could be used, first to oppose the first stage and/or second stage movement, then to return the movable members to their "free" positions—or a solenoid in combination with a mechanical device that performs one of the two functions of opposition or return. Moreover, other types of springs could be used, for example, such as a wind-up spring motor with an attached cable, or perhaps an elastomeric spring, such as a bungee cord-type of device, particularly for the return mechanism. Furthermore, a compression spring could be used that is not a round coil spring, for example.

Referring now to the drawings, FIGS. 1-13 show a hand-held screw driving tool, generally designated by the reference numeral 10, that includes a housing portion 20, a front end portion 30, a handle portion 40, and a screw feed portion 50. (Much of this structure can be viewed in FIG. 4, which is a side view of the tool 10.) Screw driving tool 10 is designed for use with a flexible strip of collated screws, and in FIG. 4, the flexible collated screw strip sub-assembly is generally designated by the reference numeral 60.

The housing portion 20 of the tool includes a front housing outer shell structure 22, and a rear housing portion that has a top gripping surface 24 as well as a bottom gripping surface (or set of surfaces) 42, that are also part of the handle portion 40. Housing portion 20 is also sometimes referred to herein as an "elongated housing." Toward the front of housing portion 20 is a "fixed feed tube" 26, that houses some movable portions of the tool 10, as discussed below. In the illustrated embodiment, the feed tube 26 is fixedly attached to the housing portion 20. In the illustrated embodiment, a "movable feed tube" 28 is one of the movable elements of the tool.

The front end portion 30 includes a moveable nose piece 32, which is attached to a slide body sub-assembly 34. Both the nose piece 32 and slide body sub-assembly 34 are moveable in a longitudinal direction of the tool 10, and when the nose piece 32 is pressed against a solid object, the screw driving tool 10 will be actuated to physically drive one of the screws into the solid object, also referred to herein as the "workpiece." Nose piece 32 has a front surface 36, which preferably has a rough texture such as sandpaper, so that it will not easily slide while pressed against the surface of the workpiece when the tool is to be utilized. In the illustrated embodiment of FIGS. 1-3, the nose piece 32 is detachable from the slide body sub-assembly 34 so that the nose piece can be re-positioned for different lengths of screws. The nose piece 32 has a plurality of screw length positioning holes 38, which are used to attach nose piece 32 to the slide body sub-assembly 34 at different relative positions to one another.

The slide body sub-assembly 34 is movably attached to the movable feed tube 28, such that slide body sub-assembly 34 essentially slides along predetermined surfaces of movable feed tube 28. In addition, a slot is formed in movable feed tube 28 to provide a camming action surface (essentially a slotted opening having a curved portion and a straight portion) for a cam roller 70 to traverse as the slide body sub-assembly 34 moves, relative to the movable feed tube 28. This action is used to cause the "next" fastener of the collated strip (see below) to index to a "firing position," by way of an indexing action of the slide body sub-assembly 34 (which indexing action is internal to the slide body sub-assembly).

Handle portion 40 includes a set of bottom gripping surfaces 42 that can be used by a person's hand to readily grip the handle and not easily slide along the bottom surface of the housing portion 20. Handle portion 40 also includes a trigger 44, which is used to actuate an electrical switch to operate the internal drive mechanisms of the hand-held portable tool 10. In the illustrated embodiment, a power cord 46 is attached at the bottom area of handle portion 40, which provides electrical power to the internal drive mechanism of the tool 10. Note that some fastener-driving tools have a battery sub-assembly to provide the electrical power, which of course can be used with the present invention.

Figure 4:
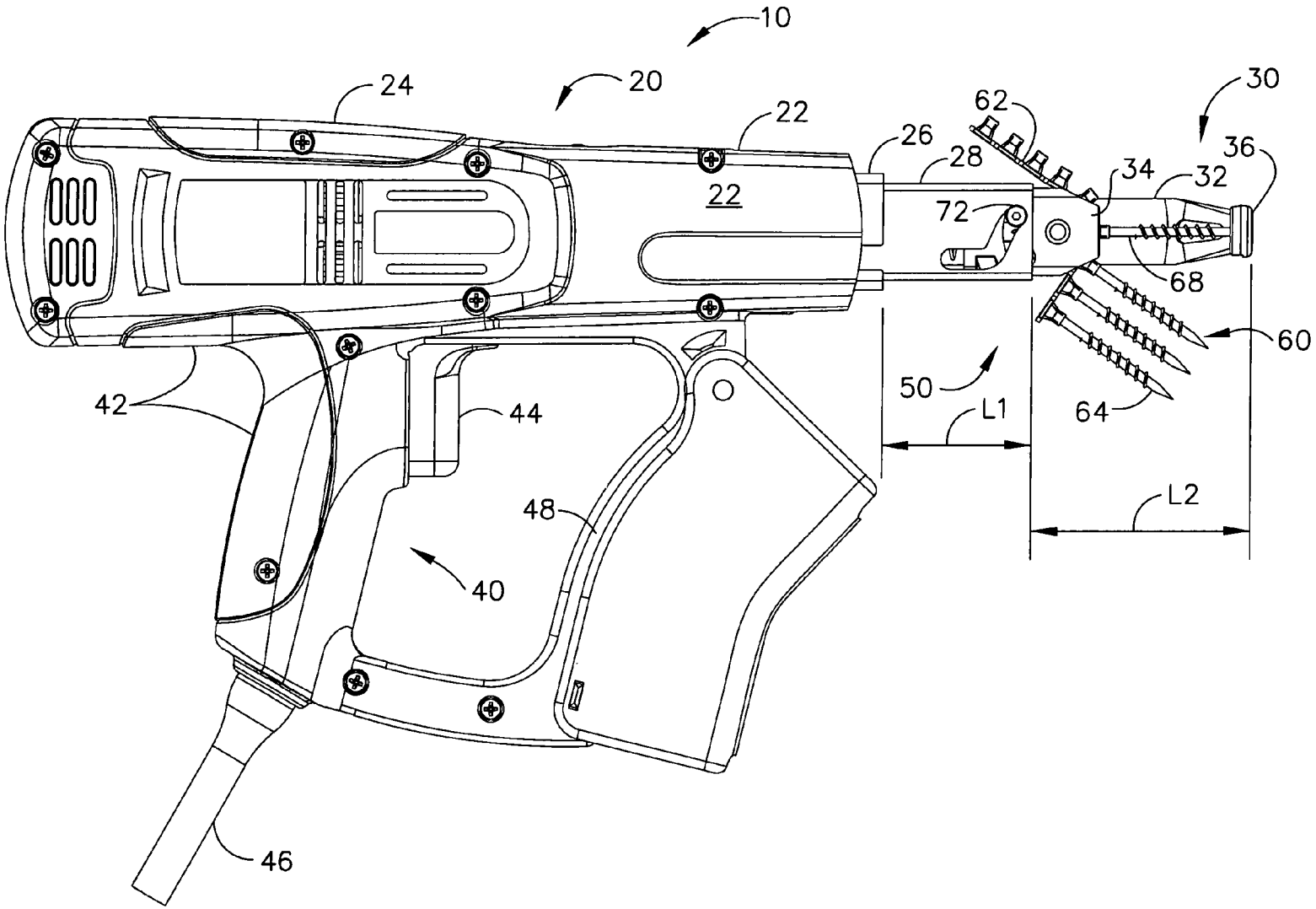
FIG. 4 is a side elevational view of the tool of FIG. 1, illustrated in its free, non-actuated state.

Handle portion 40 also includes a curved guide member 48 that can receive a flexible collated strip of screws, in this case the collated screw sub-assembly 60. The collated screw sub-assembly 60 mainly consists of a plastic strip 62 that has several openings to receive individual screws 64. The overall collated screw sub-assembly is flexible to a certain degree, as can be seen in FIG. 4 by the curved orientation of the plastic strip 62 as it is fed through the guide 48 and up toward the nose piece 32 and the slide body sub-assembly 34.

Some of the mechanical mechanisms described above for the portable screw driving tool 10 has been available in the past from Senco Products, Inc., including such tools as the Senco Model Nos. DS162-14V and DS200-14V. These earlier tools utilized a fixed feed tube only, and there was no equivalent movable feed tube structure, only a movable slide body 34 and nose piece 32 structure. Some of the components used in the present invention have been disclosed in commonly-assigned patents or patent applications, including a U.S. Pat. No. 5,988,026, titled SCREW FEED AND DRIVER FOR A SCREW DRIVING TOOL; a U.S. patent application titled TENSIONING DEVICE APPARATUS FOR A BOTTOM FEED SCREW DRIVING TOOL FOR USE WITH COLLATED SCREWS, filed on Sep. 29, 2004, having the Ser. No. 10/953,422; a U.S. patent application titled SLIDING RAIL CONTAINMENT DEVICE FOR FLEXIBLE COLLATED SCREWS USED WITH A TOP FEED SCREW DRIVING TOOL, filed on Oct. 13, 2004, having the Ser. No. 10/964,099; and a U.S. patent application titled METHOD AND APPARATUS FOR COOLING AN ELECTRIC POWER TOOL, filed on Dec. 27, 2004, having the Ser. No. 11/023,226.

The main purpose of tool 10 is to drive screws that are provided in the form of the flexible collated strip sub-assembly 60. The individual screws 64 are held in place by a flexible plastic strip 62, and as the screws traverse through the guide member 48, they are ultimately directed toward the front end portion of the tool 30 until each of the screws 64 reaches a "drive" position at 68 (see FIG. 6). When viewing the tool 10 at its front-most portion (i.e., the right-hand portion as viewed in FIG. 6), the left-most screw 64 has been indexed to the drive position at 68, and thus is now essentially co-linear with the main drive components of the portable tool 10. As the collated screw sub-assembly 60 is moved through the screw feed portion 50, the plastic strip 62 will eventually make contact with a sprocket (not visible in FIG. 6) that acts as a rotary indexer, and which is located inside the slide body sub-assembly 34. The sprocket moves each of the portions of the plastic strip 62 into a proper rotary position so that their attached screws 64 eventually end up in the front-most drive position 68.

When the nose piece 32 is actuated by being pressed against a workpiece (see FIG. 14), then a drive bit 66 will push the screw at 68 into the workpiece, and the drive bit 66 will also then be turned in a rotary motion to twist the screw at 68 in the normal manner for driving a screw 64 into a solid object. Once the screw at 68 has been successfully driven into the solid object, then the tool 10 is withdrawn from the surface of the solid object, and of course the screw 64 remains behind and has now broken free from the plastic strip 62 (see FIG. 12: screw at 68 is already free from the plastic strip 62). In one mode of the invention, the tool 10 will now be free to allow the sprocket to perform its rotary indexing function and to bring forth the next screw 64 into the front-most drive position at 68. This type of screw-feed actuation can be referred to as "indexed on return," since the "lead screw" is moved into the "firing position" at 68 as the nose piece 32 is released (or "returned") from the surface of the workpiece.

The tool 10 can also be configured in an alternative screw-feed actuation mode, in which the lead screw is moved into the firing position at 68 as the nose piece 32 is pressed against the surface of a workpiece; this type of screw-feed actuation can be referred to as "indexed on advance." If tool 10 is configured for indexed on advance, then the lead screw would not yet be in the position at 68 (as seen on FIGS. 4, 5, 6, and 7) at the moment the nose piece 32 is "relaxed" or "free," in its non-firing state. Instead, the lead screw is not indexed into the firing position at 68 until the nose piece 32 is "pushed in" (or "advanced") toward the main body portion of the tool 10 (e.g., toward the handle portion 40), which is a state of the tool illustrated in FIGS. 8-10, and discussed below in greater detail. Note that the indexed on advance configuration is a preferred mode of operation for tool 10. It will be understood that both the indexed on advance and indexed on return screw-feed actuation modes of operation can work with the present invention.

Referring now to FIG. 4, the portable tool 10 is seen from its side, and the gripping surfaces 42 are seen as being relatively continuous along the back portion (to the left in the view of FIG. 2) of the tool 10. A human user will typically use both hands to hold the tool 10 in place while it is being actuated to drive a screw into an object. One of the user's hands can be placed on the top surface 24, while the other user's hand can grasp the handle portion 40 at the lower gripable surface 42, while also actuating the trigger 44. The tool 10 in FIG. 4 is shown in a non-actuated or "free" state, in which the front surface 36 is not being pressed against a solid object that would tend to actuate the unit. FIGS. 4-7 and FIG. 1 are views of tool 10 in this free, non-actuated state. As will be described below in greater detail, there are two "stages" of actuation of tool 10, such that the front surface 36 of the nose piece 32 is pressed against a solid object, which then deflects the nose piece 32 "back" toward the remaining portions of the tool 10. The first portion of the lateral movement of the nose piece 32 will be referred to herein as the "stage 1" movement, and when stage 1 is complete, the tool will have an appearance as depicted in FIGS. 8-10 and FIG. 2. The second portion of the lateral movement of the nose piece 32 will be referred to herein as "stage 2" movement, and when the stage 2 movement is complete, the tool 10 will have the appearance as illustrated in FIGS. 11-13 and FIG. 3.

Figure 2:
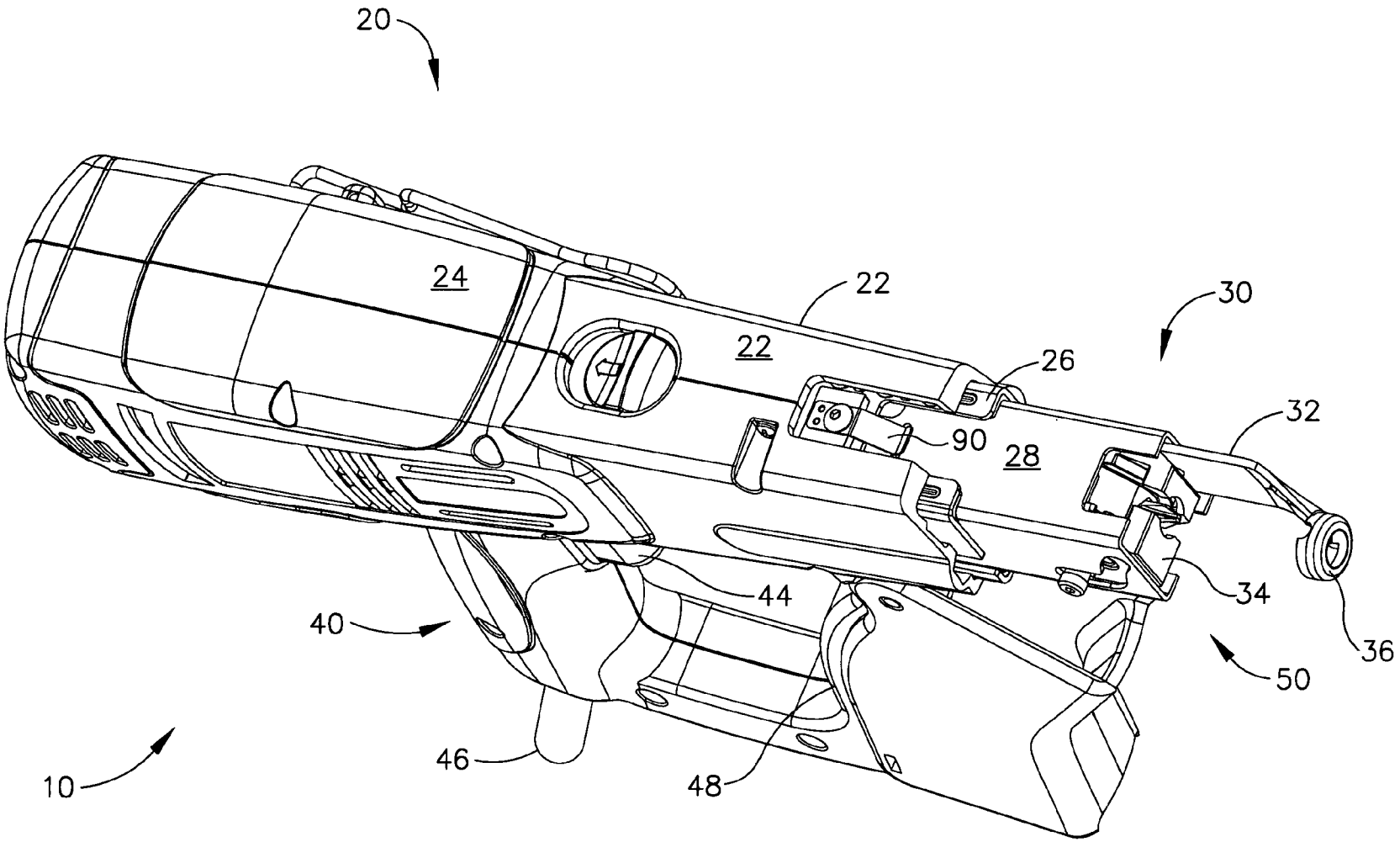
FIG. 2 is a perspective view of the tool of FIG. 1 illustrated in an actuated state, after its nose piece has moved through a first stage of movement.
Figure 3:
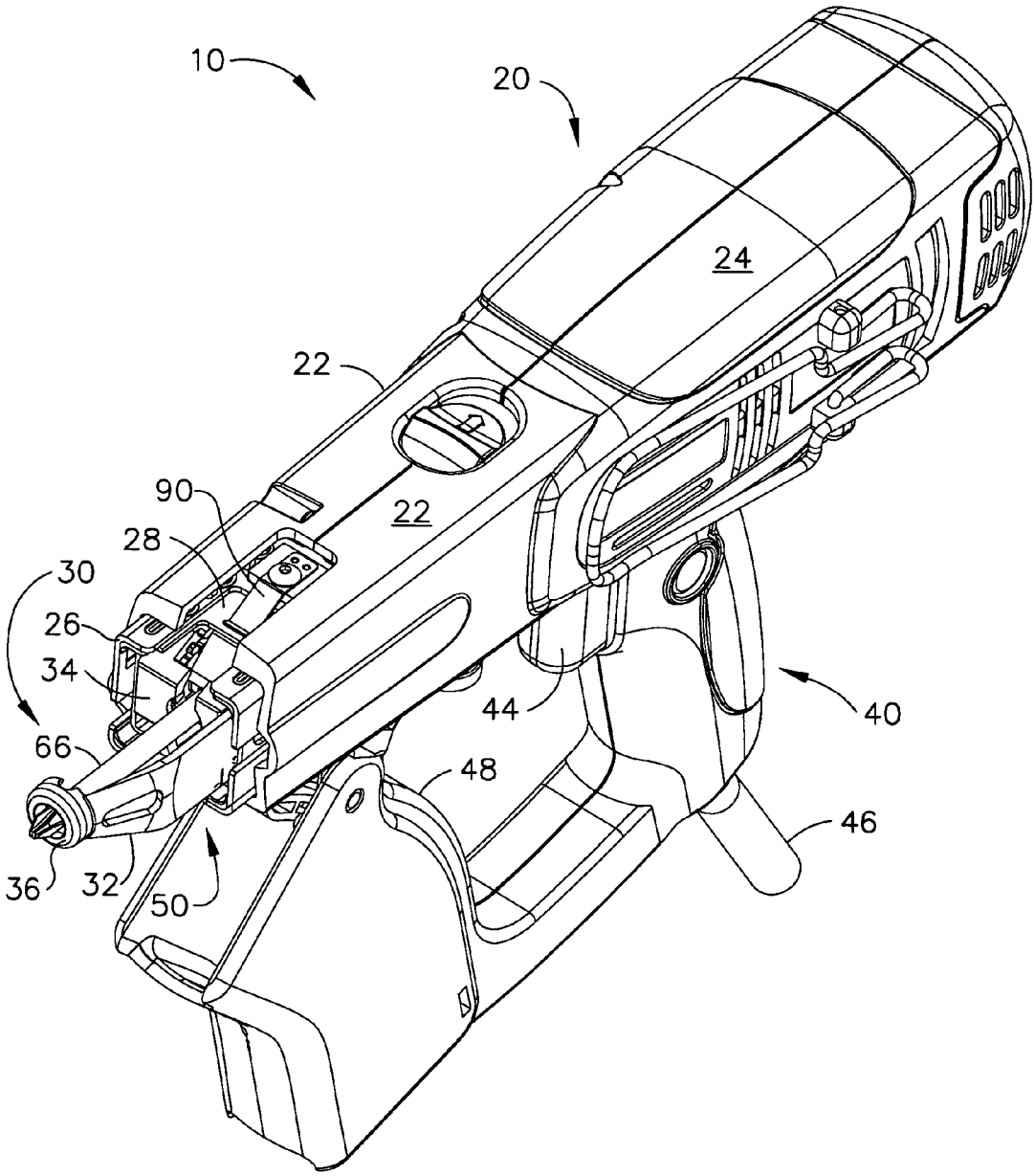
FIG. 3 is a perspective view of the tool of FIG. 1 illustrated in an actuated state, after its nose piece has moved through its second stage of movement.

Referring now to FIGS. 1-3, the portable tool 10 is illustrated in a perspective view from the top and from one of the sides. In FIG. 1, tool 10 is in its non-actuated state, and the nose piece 32 is depicted in its "free" position, in which the distance between the nose piece front surface 36 and the housing 22 of the tool is at its maximum distance. (Note that this maximum distance is adjustable by the user, typically so as to be able to use the tool 10 with different screw sizes.) In FIG. 1, the "movable feed tube" 28 extends to the right (in FIG. 1) and away from the "fixed feed tube" 26, and the nose piece 32 and its associated slide body sub-assembly 34 extend beyond (and to the right in FIG. 1) the outermost (or right-most) portion of the movable feed tube 28. In this state, a leaf spring 90 is visible such that it is positioned in a slot in the upper surface of the movable feed tube 28.

Referring now to FIG. 2, the stage 1 movement has occurred, in which the nose piece 32 has been deflected or pushed "back" toward the remaining portions of the tool 10. At the end of the stage 1 movement, nose piece 32 is positioned such that its associated slide body sub-assembly 34 is approximately even with the outermost (or right-most in FIG. 2) portion of movable feed tube 28, and the nose piece and slide body sub-assembly have essentially "collapsed" into the movable feed tube 28. However, movable feed tube 28 has not yet moved with respect to the fixed feed tube 26, at least not to any substantial distance. In this state, the leaf spring 90 is still positioned such that it is contacting a slot in the upper surface of the movable feed tube 28.

Referring now to FIG. 3, the second stage movement has occurred such that the nose piece 32 has been pushed back to its furthest extent, in which both the nose piece 32 and the movable feed tube 28 have essentially "collapsed" into the fixed feed tube 26. In this state, the leaf spring 90 is nk longer positioned into the slot in the upper surface of the movable feed tube 28, since movable feed tube 28 has moved "backward" toward the remaining portions of the tool 10, and the slot in its upper surface has accordingly also moved away from that portion of leaf spring 90. This construction and arrangement will be seen in greater detail in reference to other views, described below. In FIG. 3, it can be seen that the movable feed tube 28 is essentially hidden within the structure of the fixed feed tube 26, at least from any side view of the tool 10. The drive bit 66 is now visible, and its front-most portion at its "tip" is visible as protruding through the opening in the front surface 36 of the nose piece 32. If a fastener had been loaded into the tool 10, it would have been pushed into the solid object that had been pressed against the front surface 36 of the tool 10.

Referring again to FIG. 4, the tool 10 can be seen with its nose piece 36 fully extended and the movable feed tube 28 also fully extended, since the tool is in its "free," non-actuated state. In this free state, the front-most portion of the movable feed tube 28 extends beyond the front-most portion of the fixed feed tube 26 by a distance referred to on FIG. 4 as "L1." By reference to the "front-most" position, this is to the right on FIG. 4. Similarly, the front-most portion of the nose piece 32 extends beyond the front-most portion of the movable feed tube 28 by a distance denoted "L2" on FIG. 4.

Referring now to FIG. 5, the tool 10 is again shown in a side view, and is illustrated in a cross-sectional view to show some of the internal components. A prime mover device (such as an electric motor) is generally designated by the reference numeral 52, which provides the drive power for the tool 10. In the illustrated embodiment of FIG. 5, tool 10 also contains a clutch at 54, and other mechanical components (e.g., a gearbox to reduce the rotational speed and increase the torque) that tend to rotate the drive bit 66, when the tool is actuated. It should be noted, however, that the bit 66 typically should not be rotated until a fastener such as a screw is properly positioned in a "drive position," which is the position of a screw on FIG. 5 that is illustrated at the position 68. Once drive bit 66 engages the head of the screw illustrated on FIG. 5, then the prime mover device and other mechanical components will be allowed to rotate the drive bit 66, thereby rotating the screw that is in the drive position at 68.

Figure 5:
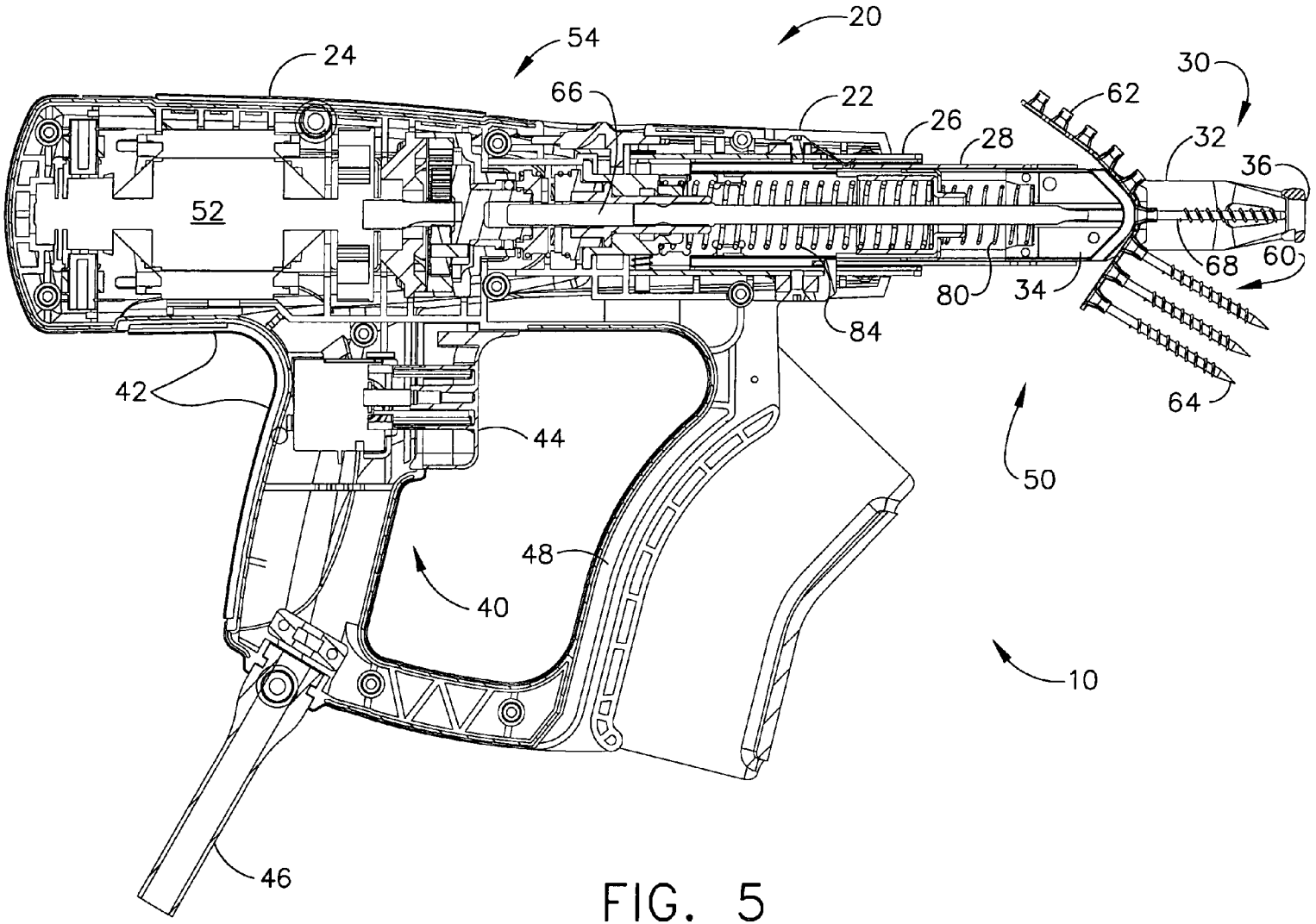
FIG. 5 is a cross-section side view of the tool of FIG. 1, also shown in its free, non-actuated state.
Figure 6:
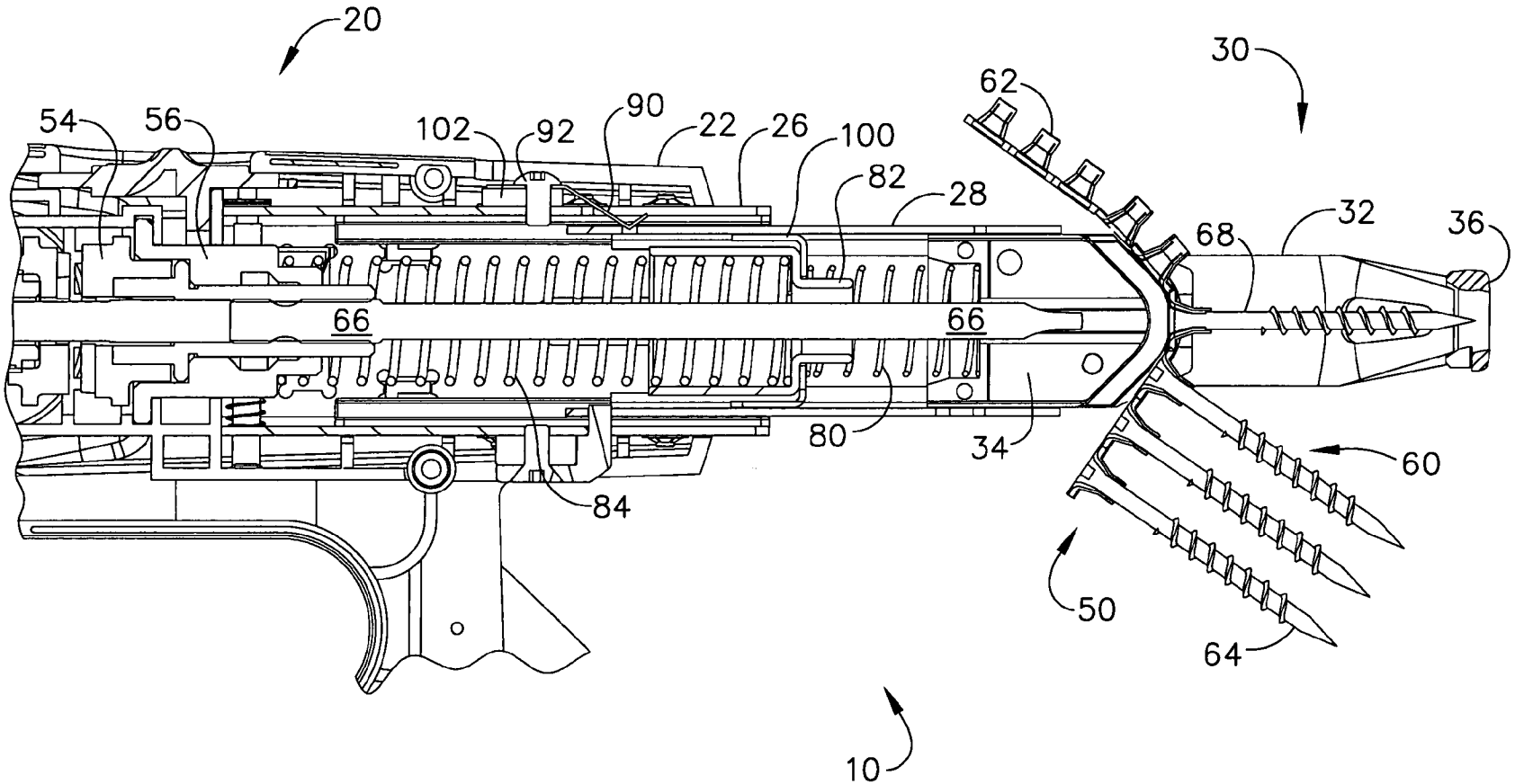
FIG. 6 is an enlarged cross-section view from the side of the tool of FIG. 1 in its free, non-actuated state.

FIG. 6 is provided to show an enlarged view of some of the components of the cut-away side view of FIG. 5. The tool 10 has two major return springs, a first return spring at 80 and a second return spring at 84. Both of these springs are illustrated as being coil springs, in which the first spring 80 tends to oppose the movement of the nose piece 32 and its associated slide body sub-assembly 34, as these devices are pressed back toward the left (on FIG.6) portion of the tool 10. As can be seen from FIG. 6, such a linear leftward movement would tend to compress the coil spring 80. As spring 80 is compressed, its left-most (on FIG. 6) portion is pressed against a spring post 82, which holds the spring 80 in a stacked-up coiled position as it deflects. A spring plate 100 also assists in keeping spring 80 in its proper position as it is being deflected by movement of the slide body subassembly 34.

The second coil spring 84 is shown in its expanded position in FIG. 6, and normally it is preferred that it not substantially deflect until the end of the stage 1 movement, in which the screw will have been indexed into the drive position 68 before allowing the movable feed tube 28 to be moved by any substantial distance. The coil spring 84 can either be much stronger than the other (first) coil spring 80, or a supplemental spring such as a leaf spring or other mechanical latching device could be used to assist in keeping the movable feed tube 28 from deflecting during the stage 1 movement of the nose piece 32. In FIG. 6, a leaf spring is used, which is illustrated at 90, and which is held in place by a leaf spring block 104 and a screw 92. Leaf spring 90 extends down and to the right (in FIG. 6) such that its lower-most portion fits into a slot or opening in the top surface of the movable feed tube 28. This slot is viewable in the perspective views of FIGS. 1 and 2. In this configuration, leaf spring 90 acts as a detent device.

The movements of the springs are more fully described below in reference to the other figures. Another component visible in FIG. 6 is a drive bearing 56, which receives the rotational movement from the clutch 54 and imparts that movement to the drive bit 66. It should be noted that FIG. 6 illustrates a screw 64 in the drive position 68, but this is for illustrative purposes only. If the tool 10 is designed as an "indexed on advance" tool, which is a preferred mode of the invention, then the screw will not yet have reached the drive position at 68 in this free state. On the other hand, if the tool 10 is designed as an "indexed on return" tool, then the screw could be positioned at the drive position 68 during (or before) the free state that is illustrated in FIG. 6. In such an indexed on return tool, the two-stage movements controlled by the springs 80 and 84 would not involve indexing a fastener to the drive position during the "first stage" of movement of the nose piece 32. However, it must be remembered that the rotation of the drive bit 66 should not commence with regard to driving a screw or other type of rotatable fastener until the drive bit has actually engaged the slot or recess of the screw head successfully.

Figure 7:
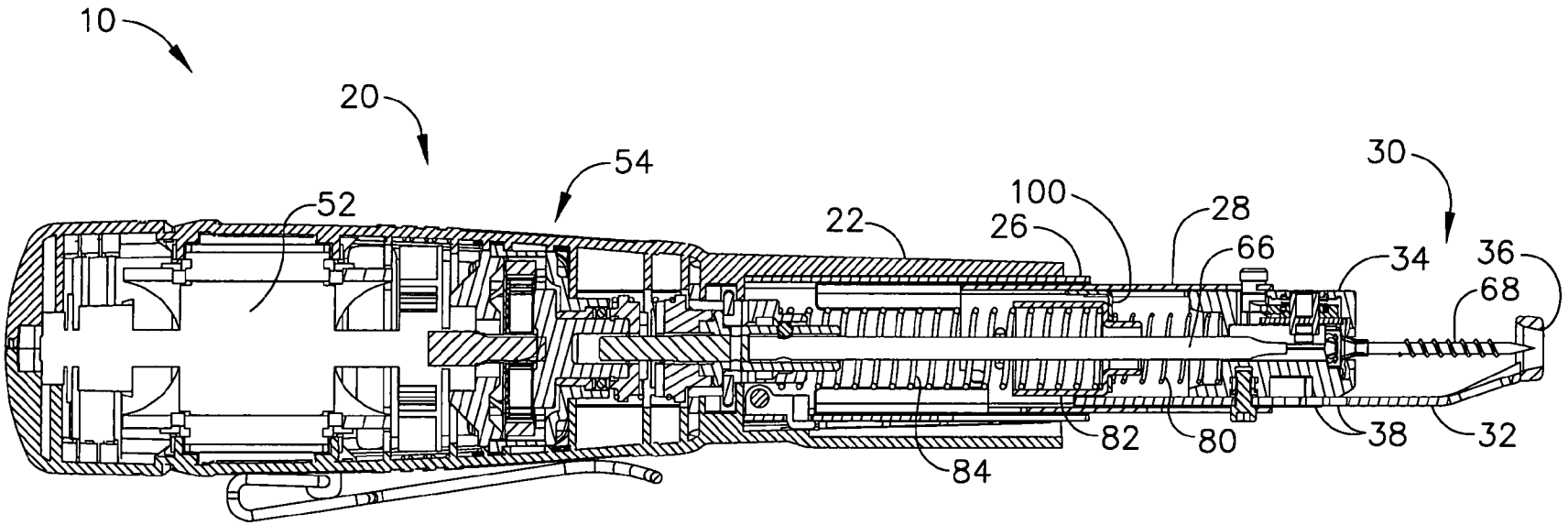
FIG. 7 is a bottom plan view in cross-section of the tool of FIG. 1, shown in its free, non-actuated state.

Referring now to FIG. 7, some of the same internal components can be seen in this bottom section view, including the extended coil springs 80 and 84, along with the spring post 82 and spring plate 100. The relative positions of the fixed feed tube 26, movable feed tube 28, and the nose piece 32 with its associated slide body sub-assembly 34 are depicted. In addition, the "length positioning holes" 38 can be seen in the cross-section view of the nose piece member 32.

Figure 8:
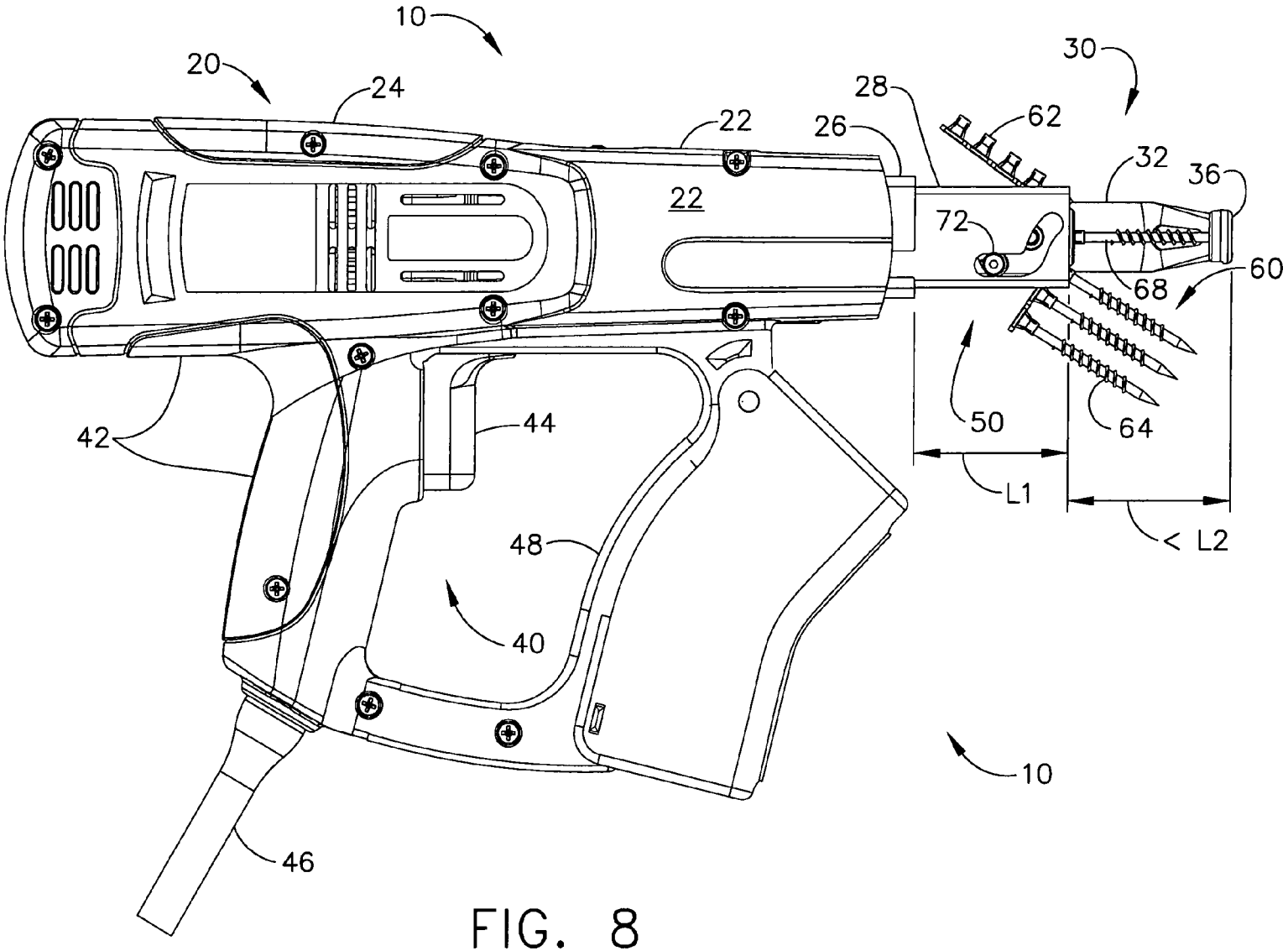
FIG. 8 is a side elevational view of the tool of FIG. 1, illustrated in its stage 1 movement state.

Referring now to FIG. 8, the tool 10 is illustrated in a state where it has been actuated and its nose piece 32 has been deflected through its stage 1 movement. FIG. 8 shows the positioning of the tool components when the stage 1 movement has essentially been completed. The front of the fixed feed tube 26 is still separated from the front of the movable feed tube 28 by substantially the distance L1. However, nose piece 32 has been pushed to the left (on FIG. 8), such that the front surface 36 of nose piece 32 now is separated by a distance of less than L2 from the front-most (or right-most on FIG. 8) portion of the movable feed tube 28.

Figure 9:
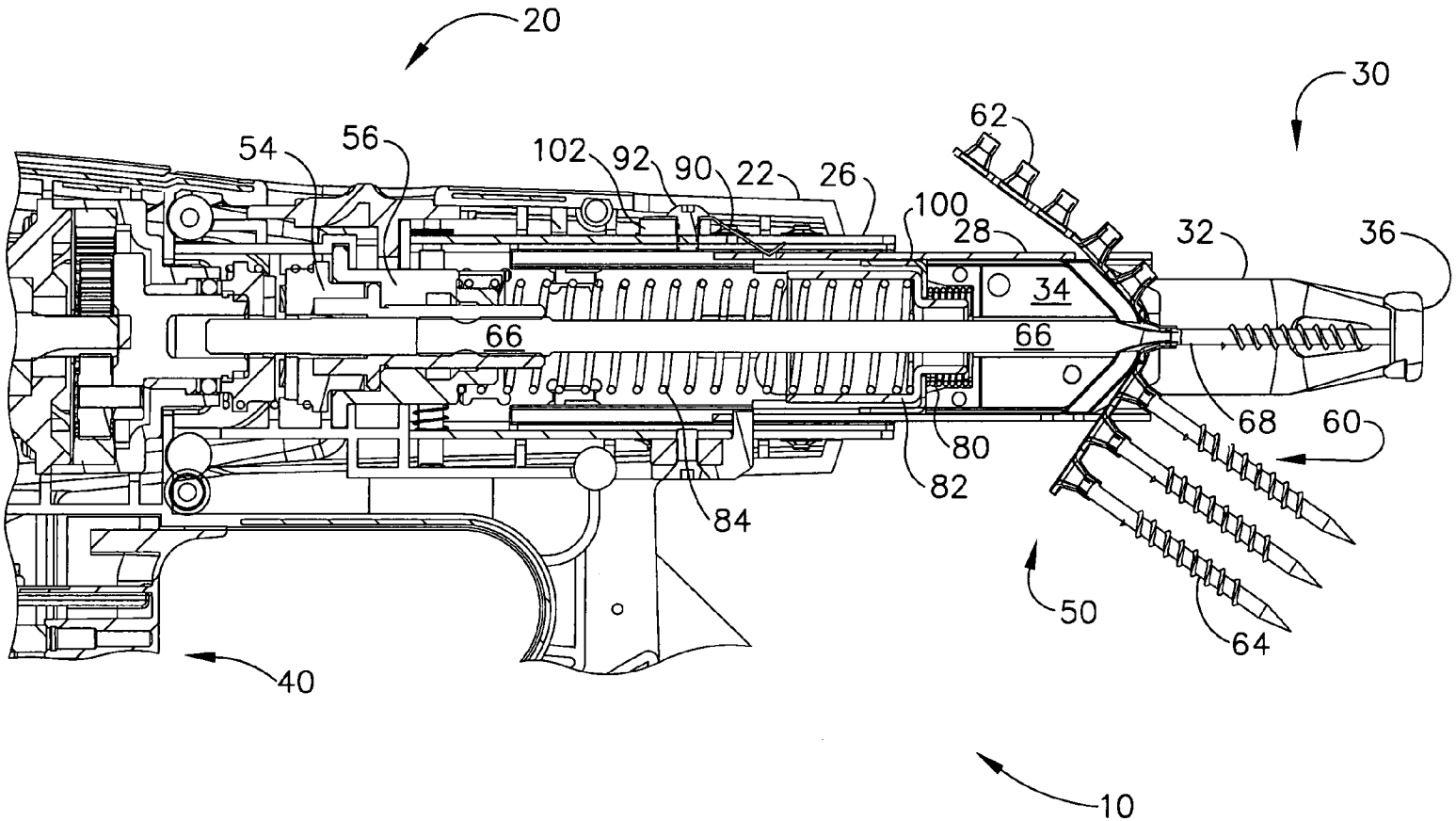
FIG. 9 is an enlarged cross-section view from the side of the tool of FIG. 1, illustrated in its stage 1 movement state.

FIG. 9 is a cross-section view from the side of the same components as viewed in FIG. 8, also after the stage 1 movement has been completed. As can be seen in FIG. 9, the drive bit 66 is now engaged into the slot or recess of the fastener (e.g., a screw 64) which is now in the drive position 68. This has been accomplished because the nose piece 32 and its associated slide body sub-assembly 34 have been pushed to the left (on FIG. 9) a sufficient distance so that the "front" tip (the right-most portion on FIG. 9) of the drive bit 66 has been held in place while the screw in the firing position 68 has been pushed against it. The slide body sub-assembly 34 has now moved into a hollow interior "receiving area" of the movable feed tube 28.

As can be seen in FIG. 9, the first return spring 80 has now been fully compressed against the spring post 82, and by the interior region of the slide body sub-assembly 34. In this state, any further linear motion toward the left will cause the movable feed tube 28 to now "collapse" toward the remaining portions of the tool 10, so that the movable feed tube 28 must travel toward the left and into a hollow interior "receiving area" inside the fixed feed tube 26. As also can be seen in FIG. 9, the leaf spring 90 is still positioned such that its lower-most portion remains in the slot area in the upper surface of the movable feed tube 28. As discussed above, the combination of the leaf spring 90 and the larger (or second) coil spring 84 has produced enough opposing force to prevent substantial movement of the movable feed tube 28 with respect to the fixed feed tube 26. This will change if the nose piece 32 continues to be pressed from the right toward the left (as viewed on FIG. 9).

Figure 10:
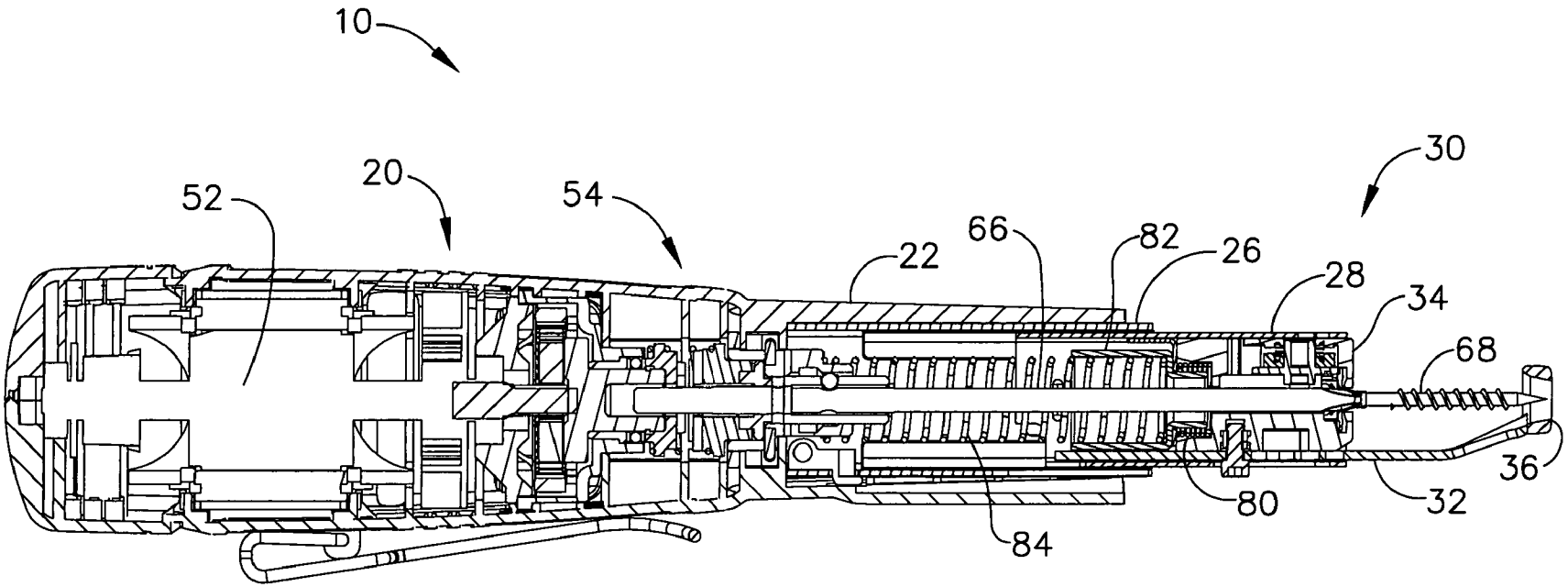
FIG. 10 is a bottom plan view in cross-section of the tool of FIG. 1, illustrated in its stage 1 movement state.

Referring now to FIG. 10, a bottom section view is provided showing essentially the same components as were seen in FIG. 9, including the non-compressed coil spring 84 and the totally compressed coil spring 80. This is the result of the nose piece 32 having been pushed from the right toward the left (on FIG. 10) through the "stage 1" movement; FIG. 10 shows the state of the tool 10 when the travel of the nose piece 32 has essentially completed this stage 1 movement. Coil spring 84 has not been substantially compressed. This is desired in general, because once that occurs, the tool 10 will also begin rotating the drive bit 66 while the screw in the drive position 68 is pressed into a solid object, against which tool 10 is being pressed. It should be noted that the drive bit 66 could commence rotation either after coil spring 80 is fully compressed (i.e., at the end of stage 1 movement), or before this spring 80 is fully compressed (i.e., during part of stage 1 movement).

Figure 11:
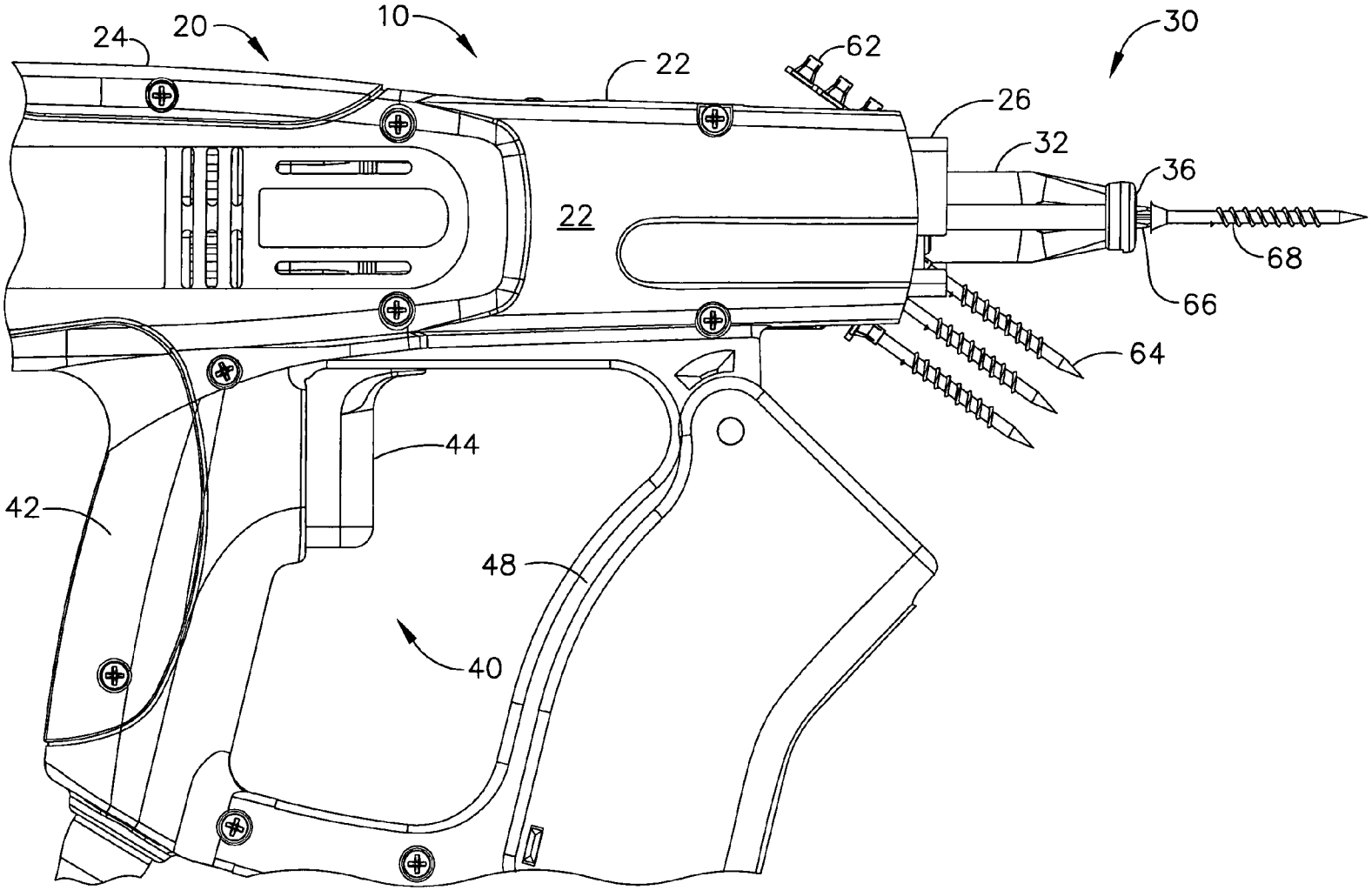
FIG. 11 is a side elevational view of the tool of FIG. 1, illustrated in its stage 2 movement state.

Referring now to FIG. 11, the tool 10 is now depicted in a "fully actuated" state, in which the nose piece 32 has been pushed as far to the left (on FIG. 11) as is possible with this mechanical construction. This is a state in which nose piece 32 has been pushed through both its "stage 1" and "stage 2" movement, which also causes the movable feed tube 28 to be forced to the left (on FIG. 11) such that it is now essentially entirely within the confines of the fixed feed tube 26 (i.e., in the hollow interior receiving area). As can be seen on FIG. 11, the movable feed tube 28 is essentially not visible at all from the side of the tool 10. It should be noted that the screw or other type of rotatable fastener that is illustrated in the firing or drive position 68 would not likely still remain at the end of the drive bit, as illustrated in FIG. 11. In general, tool 10 is used to automatically drive rotatable fasteners such as screws into a solid object, and once that has been accomplished, tool 10 is typically withdrawn rather quickly, thereby leaving the fastener behind in the solid object. For purposes of illustration, FIG. 11 is not showing the solid object, and is indeed showing the fastener still remaining in the drive position 68 while still abutting the tip of the drive bit 66.

In this view of FIG. 11, the right-most portion of the fixed feed tube is actually located further to the right than the right-most portion of the movable feed tube 28. Although the distance between these two structures started at a distance of L1, this distance has become less than zero. In other words, the separation distance has become a negative distance with respect to the original L1 dimension. This does not necessarily have to occur to use the tool of the present invention, but it is an attribute of the illustrated embodiment. During the stage 2 movement, the right-most portion of the movable feed tube 28 is always at a distance less than L1 with respect to the right-most portion of the fixed feed tube 26 (these directions are with respect to FIGS. 8 and 11).

Figure 12:
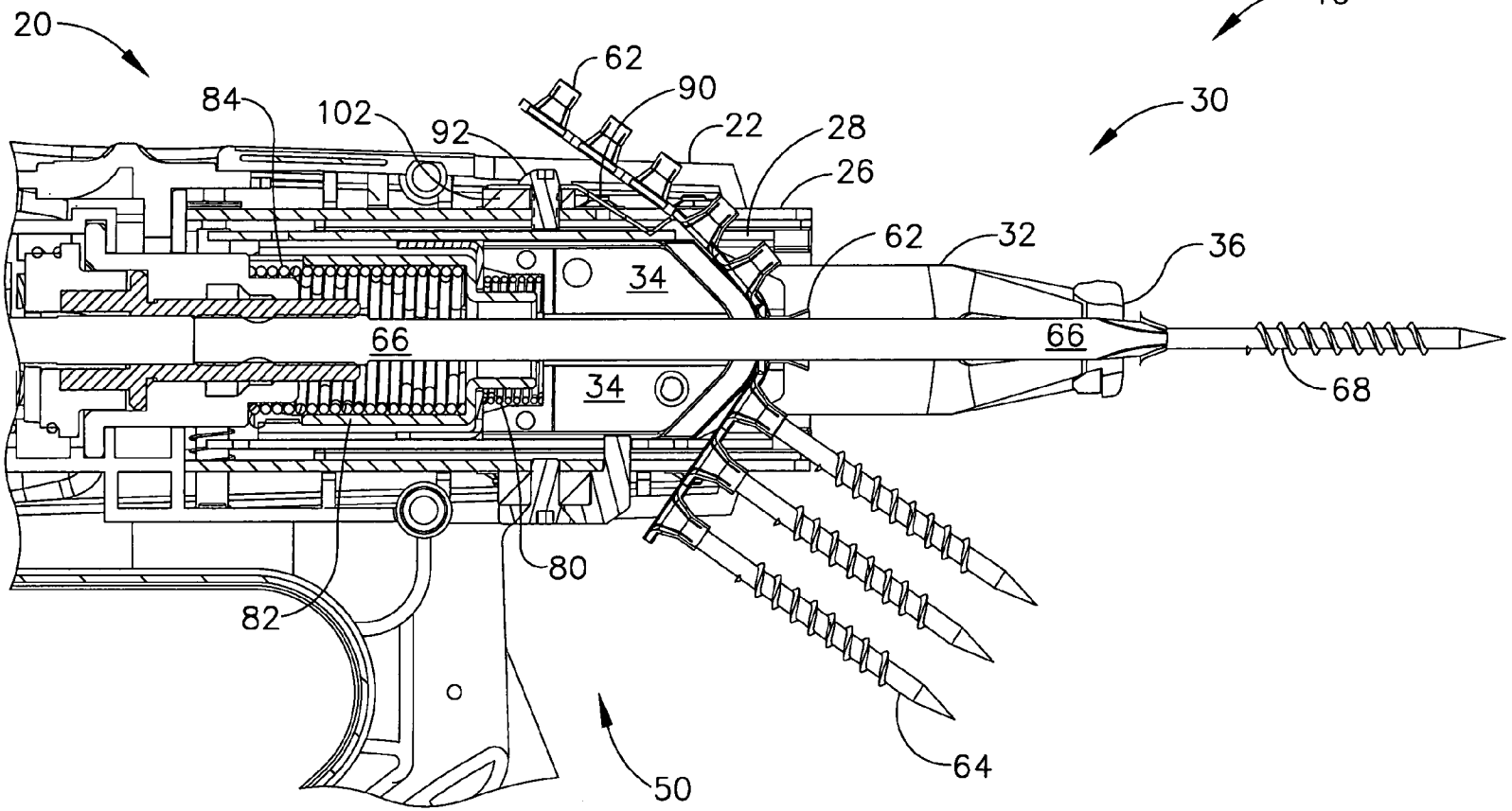
FIG. 12 is a cross-section view from the side of the tool of FIG. 1, illustrated in its stage 2 movement state.

FIG. 12 is a section view also from the side, and shows many of the internal components relating to the present invention. The tool is now fully "collapsed" such that it has had the nose piece 32 move throughout both the stage 1 and stage 2 movements, which has fully compressed both coil springs 80 and 84. In addition, the leaf spring 90 has been forced out of the upper slot in the top surface of the movable feed tube 28, and its lower-most portion now rests on the top of the upper wall surface of this movable feed tube 28. This configuration can be seen in FIG. 12. In addition, the drive bit 66 now extends entirely through the slide body sub-assembly 34, past the entire length of the nose piece 32, including its front surface 36. This is the final position of the drive bit 66 after it forces the rotatable fastener into a solid object.

Figure 13:
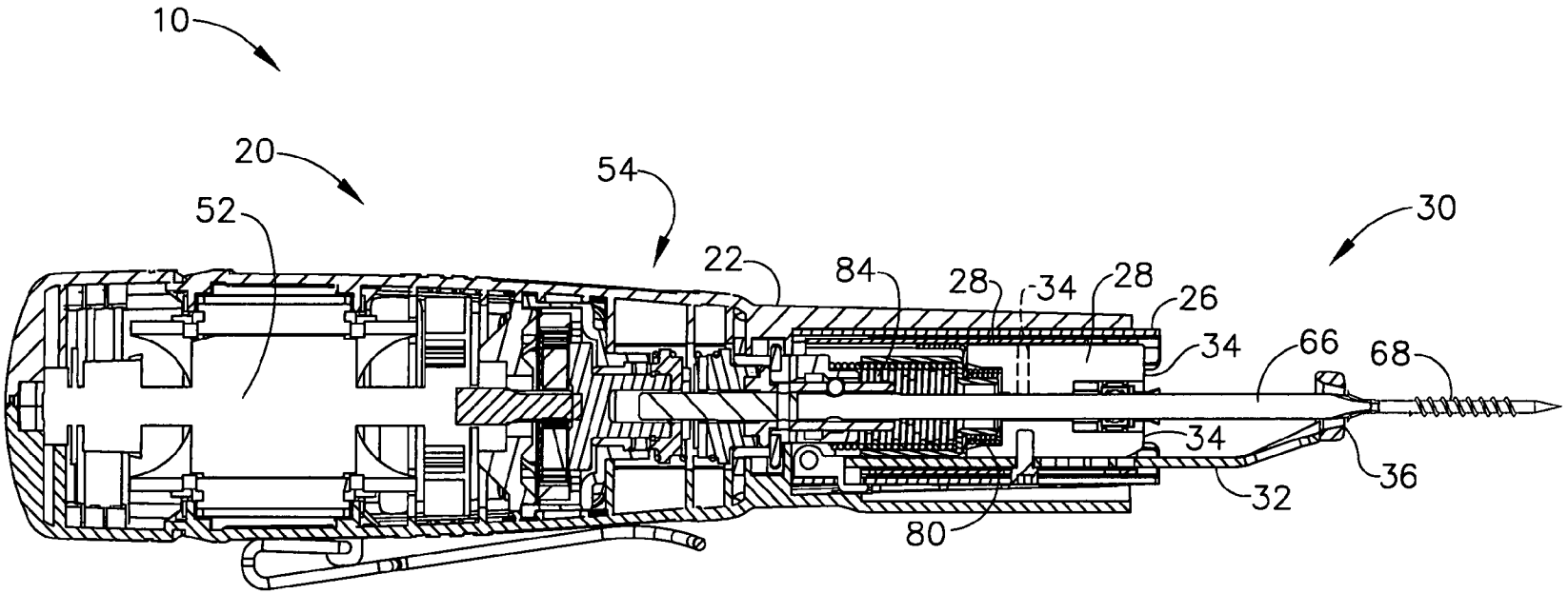
FIG. 13 is a cross-section view from the bottom of the tool of FIG. 1, shown in its stage 2 movement state.

FIG. 13 is a bottom section view showing the same major components as were seen in FIG. 12. Both coil springs 80 and 84 are illustrated in their fully compressed positions. The slide body sub-assembly 34 is only partially viewed, as this section view is taken just below the bottom surface of the movable feed tube 28 (and the slide body sub-assembly 34 is above that portion of the movable feed tube).

Figure 14:
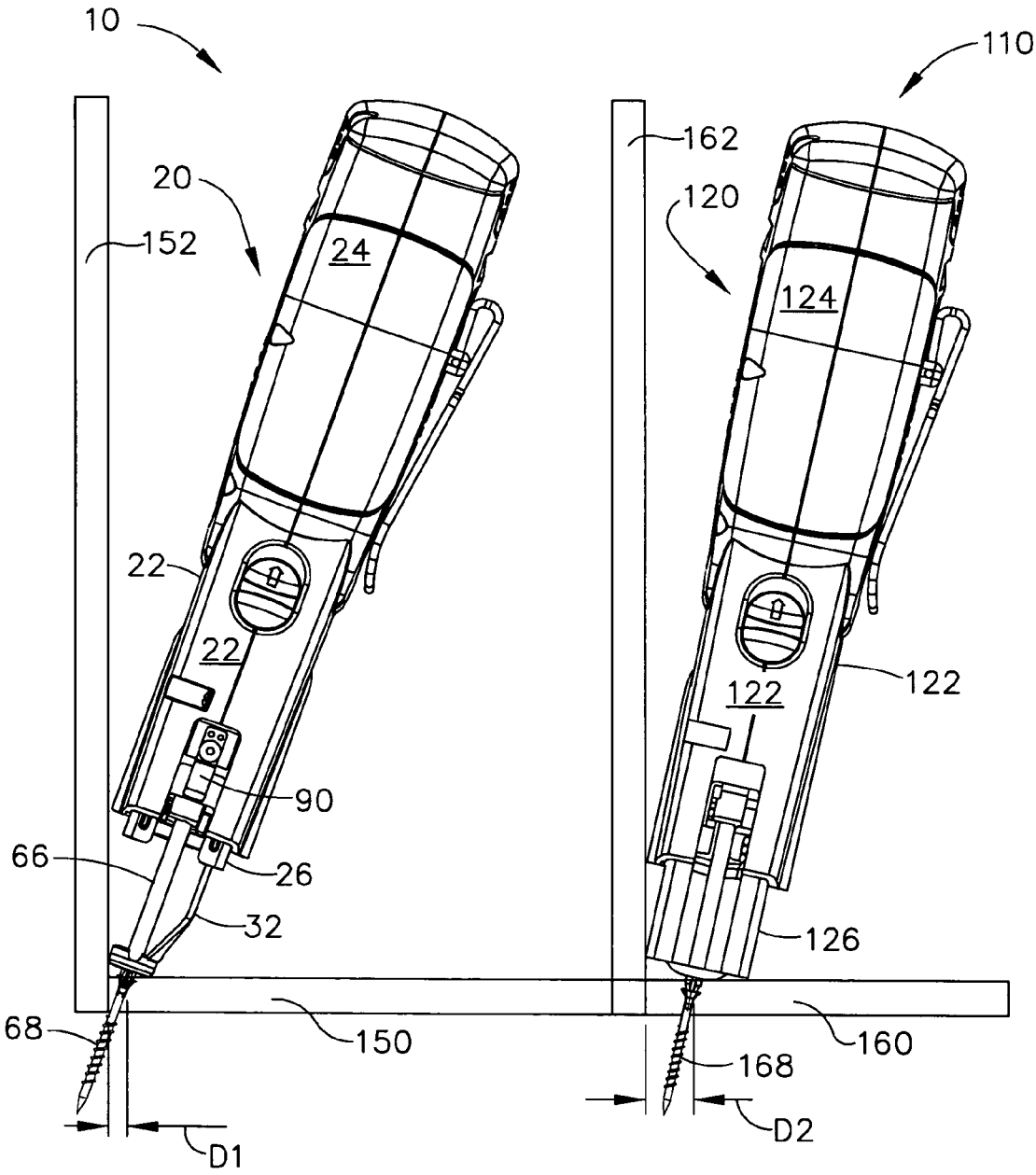
FIG. 14 is a top view of the tool of FIG. 1 placing a screw in a corner at one distance, and also a top view of an earlier Senco/DuraSpin tool placing a screw in a corner at a different distance from the corner.

FIG. 14 provides a direct comparison of some of the advantages of the present invention, as compared to previous screw fastening tools made by the assignees, Senco Products, Inc. or DuraSpin Products LLC. The tool on the left of FIG. 14 is the tool 10 of the present invention. It has placed a screw into a corner that is made up of two wall members 150 and 152. The distance the screw entered the surface 150 from the exact interior corner is illustrated by the dimension "D1." For a particular embodiment of the tool 10, this dimension D1 could be about 0.264 inches (6.7 mm).

A similar but older version of a Senco/DuraSpin tool is also illustrated in FIG. 14 on the right portion of this view, which is generally designated by the reference numeral 110. Tool 110 has a housing portion 120 that includes a front housing outer shell 122 and a top gripping surface 124. It also includes a feed tube 126 which is fixedly attached to the housing portion 120 and cannot "slide" or "collapse" back into the remaining portions of the housing 120.

Tool 110 also can place a screw near a corner. In FIG. 14, a corner is made up of wall members 160 and 162, and the screw at the screw driving position 168 can enter the wall surface 160 at a distance "D2." For a particular model of such a Senco/DuraSpin tool, this distance could be about 0.692 inches (17.6 mm). This would be a tool 110 that is essentially the same size and has the same screw driving capabilities as the tool 10 of the present invention.

As can be seen in FIG. 14, the older tool 110 is bumping the wall surface of the wall member 162 at both the left-most "near" corner of the tool housing 120 and also the left-most and lower corner of the fixed feed tube 126. This is the primary limitation that causes the minimum distance D2 to be approximately 0.7 inches in distance. On the other hand, the tool of the present invention is shown in which its housing 22 has its left-hand and lower-most corner bumping the wall member 152, but there is no feed tube in the way. Therefore, the only other restriction is the size of the front member of the nose piece 32, and this front member is also bumping the inner surface of the wall member 152. For a screw of a particular size, the front member has to have an opening to accommodate that screw. In the illustrated embodiment of FIG. 14, the minimum dimension for the closeness to the corner D1 is just barely more than one-quarter of an inch. This is almost a one-half inch improvement in the minimum spacing from the absolute corner position between the wall members 150 and 152, needed to drive a screw. It will be understood that the exact dimensional locations of fastener placement in a corner can vary without departing from the principles of the present invention, and for example, the fastener placement dimensional locations will also depend on the exact sizes of the various components of the tool (e.g., different tool models could be of different housing sizes).

Another construction application in which the present invention can be used is for the installation of windows in buildings. An exterior mount window will typically have an outer flange that mounts from the outside of the building. The tool of the present invention can readily place a screw through this flange into a building's exterior sheathing or cladding, for example, while positioning the screw near a protrusion in the window frame that otherwise can cause a clearance problem when using conventional tools.

Figure 15:
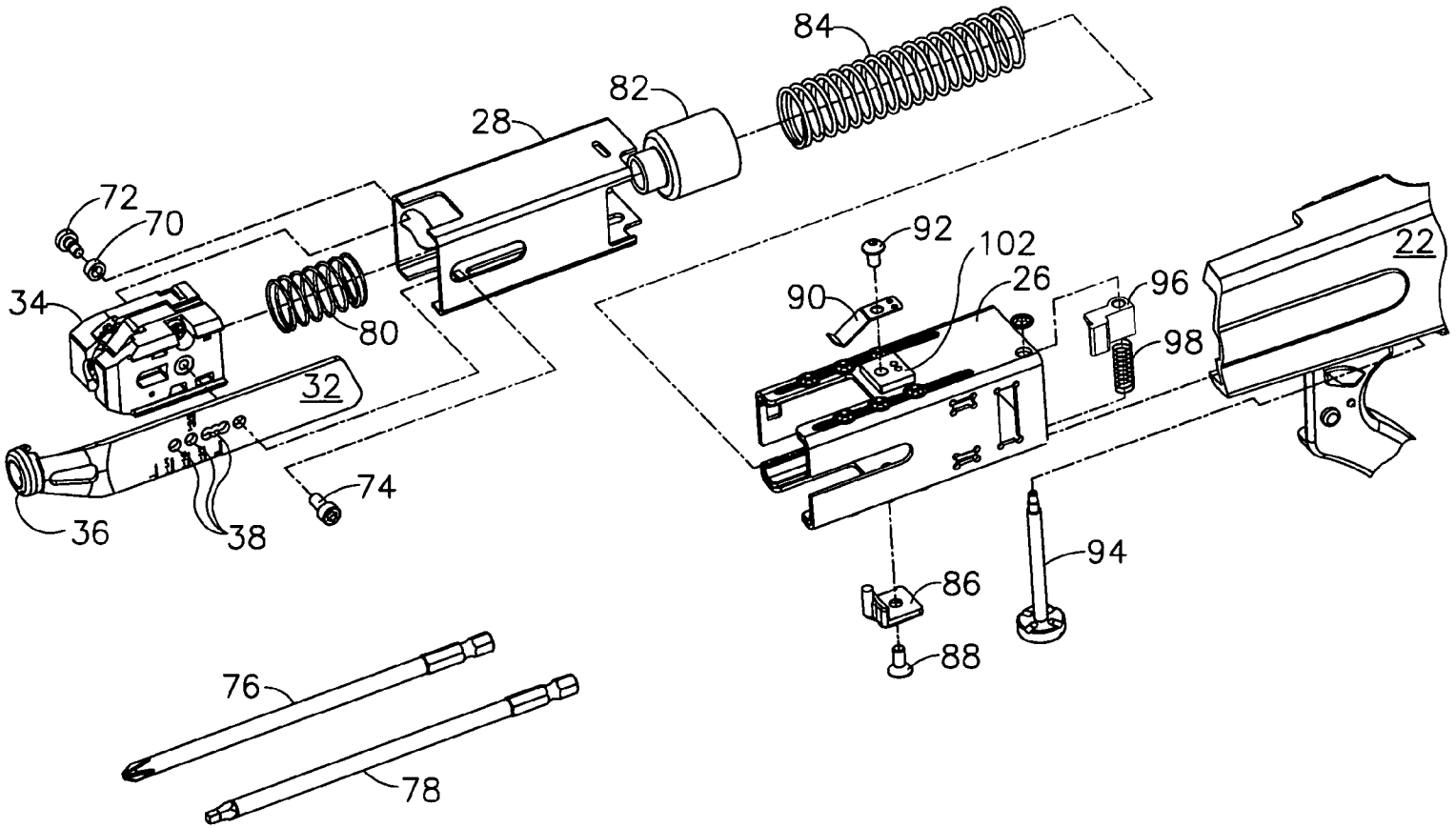
FIG. 15 is an exploded view of some of the components of the front portion of the tool of FIG. 1.

Referring now to FIG. 15, other internal components of the fastener-driving tool 10 are provided in an exploded view of these parts. Two different drive bits 76 and 78 can be provided, one having a Philips bit, the other having a square recess bit. Either bit 76 or 78 can be used as the drive bit 66 depicted in the other views. The cam roller 70 is held in place in the slide body sub-assembly by a cam screw 72. A socket cap screw 74 is used to hold the nose piece 32 into its proper position in the slide body sub-assembly 34. One of the positioning holes 38 is used to select the length of screw that will be used with the tool at a particular time. Socket cap screw 74 also holds the nose piece 32 and slide body sub-assembly 34 into relative position with respect to a slot in the movable feed tube 28.

The smaller coil spring 80 is illustrated as fitting inside the movable feed tube 28, and against the spring post 82, as illustrated in the earlier views. Spring post 82 also surrounds the outer dimensions of the coil spring 84, which itself fits into the fixed feed tube 26.

Leaf spring 90 is held in place by a screw 92 into a leaf spring block (i.e., a supporting member) 102. A slide tube latch 86 is held in place in the bottom of the movable feed tube 28 by a screw 88, which retains the movable feed tube 28 and its contents within the body of the tool 10.

The tool 10 has another adjustment with regard to how far the screw or other type of rotatable fastener will be driven into a solid object. This is controlled by a depth of drive knob 94, which enters a depth of drive block 96 through a depth of drive coil spring 98, which puts tension on the knob 94. A set of push nuts 104 are used to hold certain other members in place, as discussed below.

Figure 16:
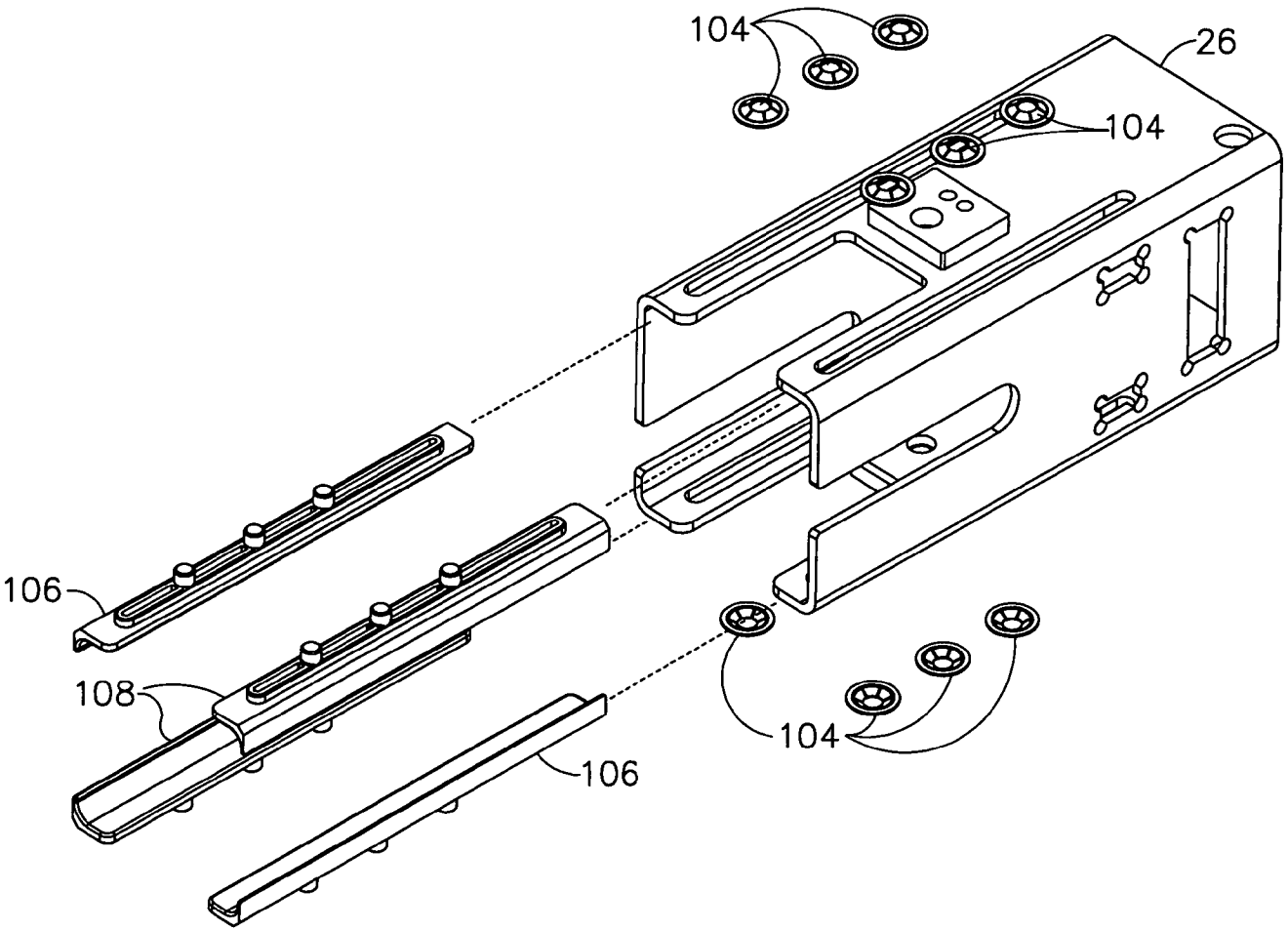
FIG. 16 is an exploded view of some of the components of the fixed feed tube of the tool of FIG. 1.

Referring now to FIG. 16, the fixed feed tube 26 includes a set of "liners" that act as guides for the movable feed tube 28, in which feed tube 28 essentially slides along these guides 106 and 108 into the fixed feed tube 26. The push nuts 104 hold these guides in place. In one embodiment of the invention, there are two different types of guides at opposite corners, and the guides are typically made of nylon or some other type of plastic with relatively low friction and low wear characteristics.

Figure 17:
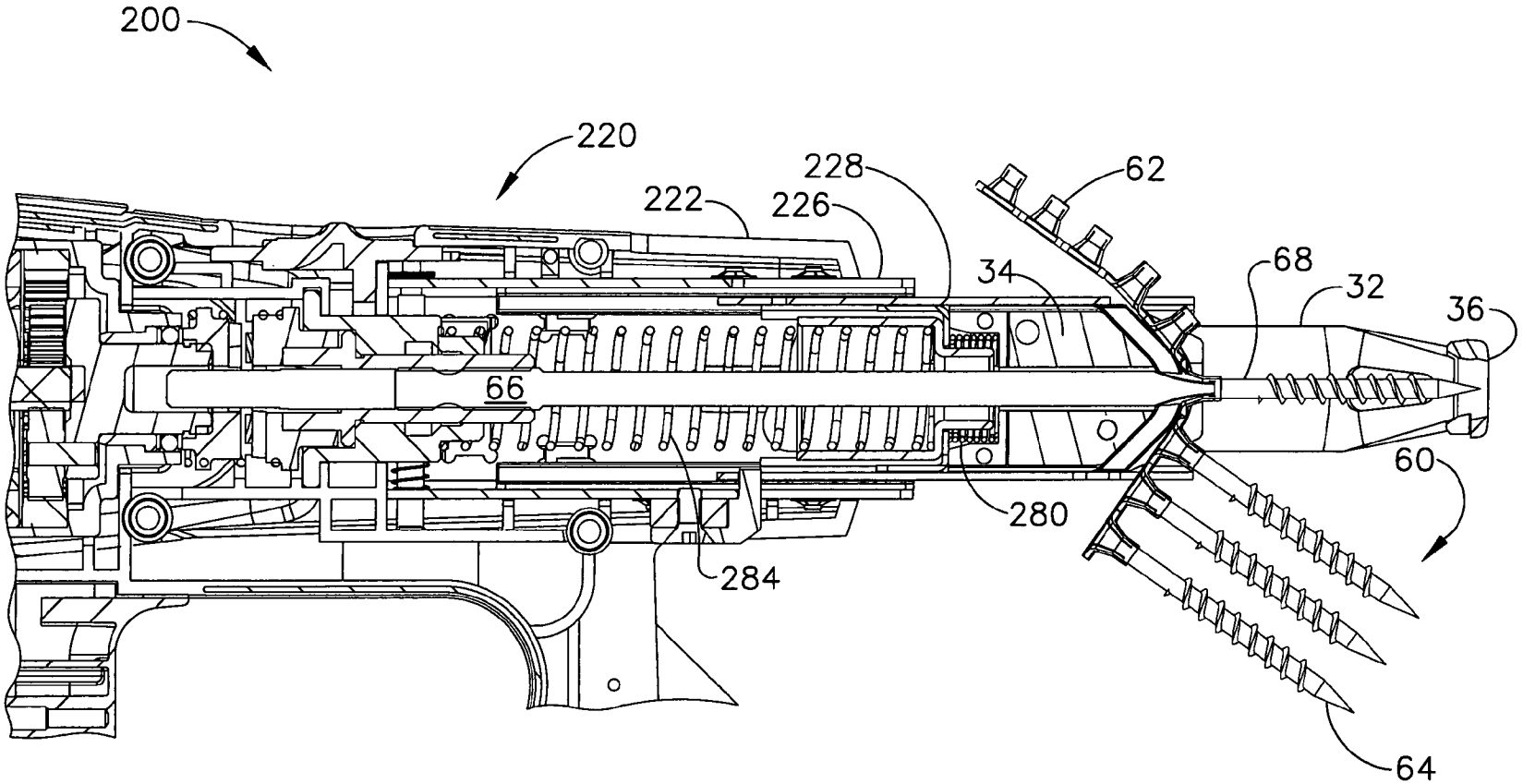
FIG. 17 is a side elevational view in cross-section of an alternative embodiment of the tool of FIG. 1, in which there is no leaf spring.

Referring now to FIG. 17, an alternative embodiment 200 is illustrated in which there is no leaf spring to assist in preventing the movement of the movable feed tube. This view is very similar to FIG. 9, which showed the tool 10 after its stage 1 movement had been completed, in which the smaller coil spring 80 was totally compressed but the larger coil spring 84 was not substantially compressed at all, and was partially assisted by the leaf spring 90.

In FIG. 17, the tool 200 has a housing portion 220 which includes a front housing outer shell 222. Tool 200 includes a fixed feed tube 226 and a movable feed tube 228. The main difference between these tubes 226 and 228 and the earlier feed tubes 26 and 28 (of FIG. 9) is the fact that there is no slot or opening for any type of leaf spring screw or leaf spring, since the top surfaces (or top members) of the feed tubes 226 and 228 do not require such slots or openings.

The coil spring 280 is shown in its fully compressed position, while the larger coil spring 284 is shown in a position where it has not been substantially compressed at all. This would be at the end of the stage 1 movement for this alternative embodiment 200. In this situation, the coil spring 284 can provide the sole opposition to the beginning of the stage 2 movement. Alternatively, some other type of latching device or other type of mechanical friction device could be used to assist the opposition forces provided by the coil spring 284, if desired.

Figure 18:
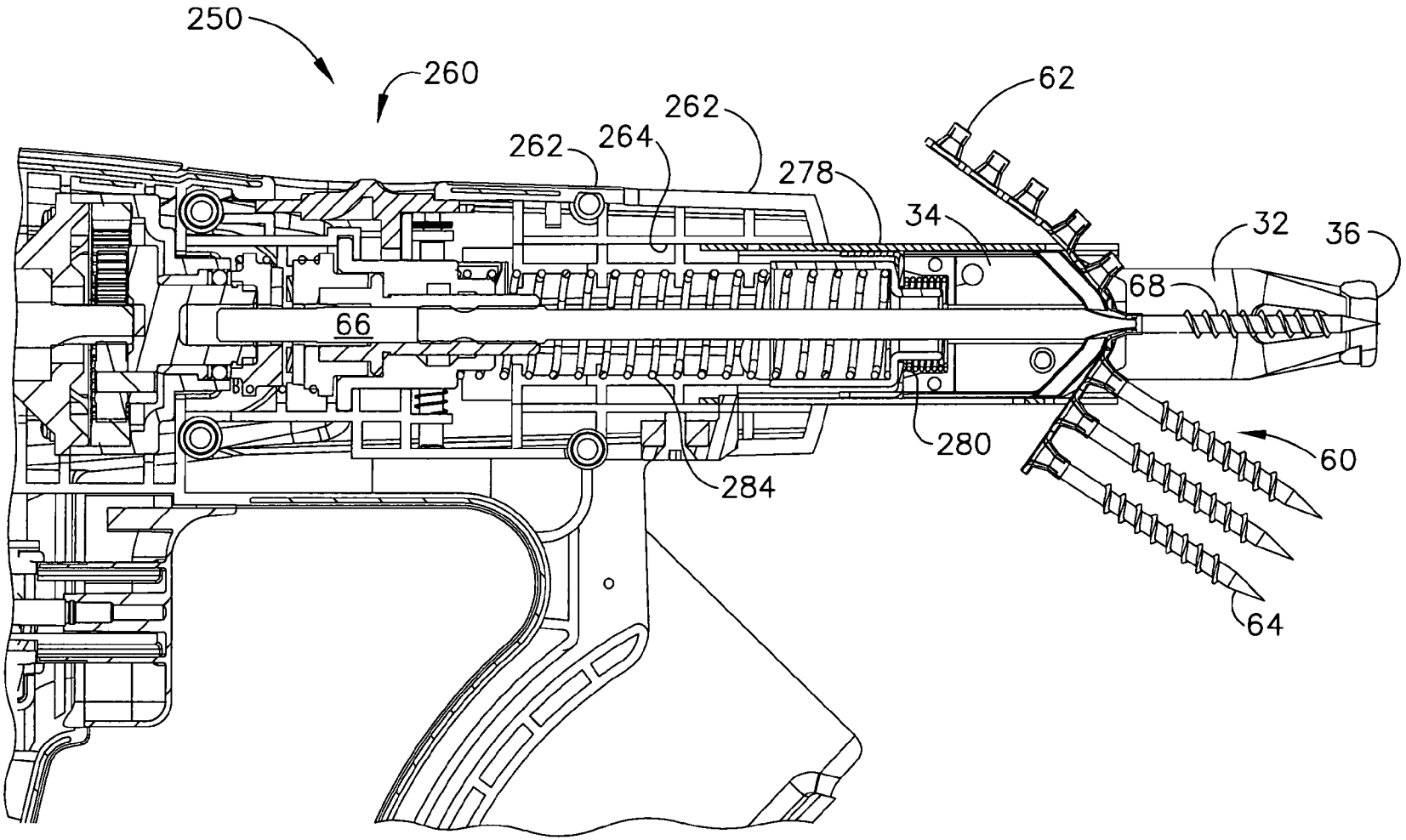
FIG. 18 is a side elevational view in cross-section of an alternative embodiment of the tool of FIG. 1, in which there is no "fixed" feed tube, but instead the housing itself acts as the linear bearing for the movable feed tube portion of the fastener driving tool.

Referring now to FIG. 18, another alternative embodiment 250 is illustrated in which there is no leaf spring to assist in preventing the movement of the movable feed tube. In addition, there also is no fixed feed tube, and instead the housing 260 itself is designed to act as a "linear bearing" surface for a movable feed tube 278. This view is very similar to FIG. 17, which showed the tool 250 after its stage 1 movement had been completed, in which the smaller coil spring 280 was totally compressed but the larger coil spring 284 was not substantially compressed at all.

In FIG. 18, the tool 250 has a housing portion 260 which includes a front housing outer shell 262. Tool 250 includes a movable feed tube 278, which linearly slides within a bearing surface that is part of the housing itself, in which this linear bearing is depicted at the reference numeral 264. Since the housing 260 provides the bearing surface in this view, there is no need for any separate "fixed feed tube" structure. In this embodiment, it should be noted that the housing 260 should be made of a material that has a relatively low sliding friction characteristic, such as nylon or some other type of plastic or polymer material such as TEFLON™, or perhaps a non-polymer material. Alternatively, a set of linear liners or guides (such as the guides 106 and 108 of FIG. 16) could be inserted into the housing portion 260, in appropriate locations. (Note that these possible guides are not shown on FIG. 18.) The smaller coil spring 280 is shown in its fully compressed position, while the larger coil spring 284 is shown in a position where it has not been substantially compressed at all. This would be at the end of the stage 1 movement for this alternative embodiment 250. In this situation, the coil spring 284 can provide the sole opposition to the beginning of the stage 2 movement. Although the movable feed tube 278 in FIG. 18 has no slot or opening for a leaf spring, this alternative embodiment could be used with some other type of "spring assist" or some type of latching mechanism, if desired, to aid in preventing the larger coil spring 284 from moving until after the smaller coil spring 280 has completed its stage 1 movement.

Figure 19:
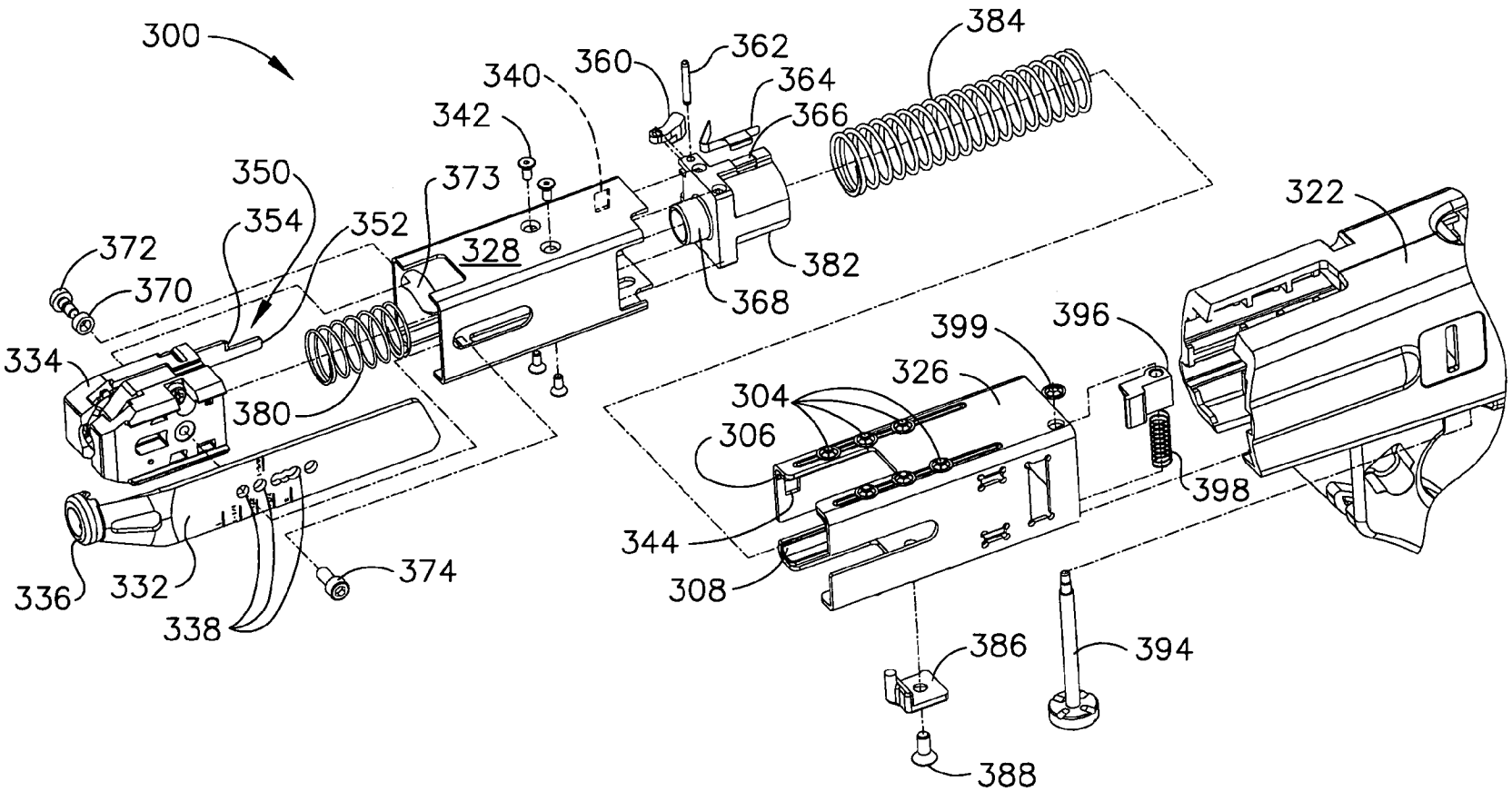
FIG. 19 is an exploded view of some of the components of yet another alternative embodiment of a fastener driving tool, in which a spring-loaded "latch lever" is used to prevent the movable feed tube from substantially moving during the first stage of movement.

It should be noted here that a single coil spring that extends from the rear portion of the "large" spring 84 all the way to the front portion of the "small" spring 80 could potentially replace the two individual springs 80 and 84. To use this configuration, a positive latching mechanism would be used to prevent the movable feed tube 28 from moving during the "stage 1 " movement of the nose piece 36 and slide body sub-assembly 34. Once a screw was properly indexed into the drive position (at 68), the positive latching mechanism would then be allowed to release the movable feed tube from its "confinement," and then movable feed tube 28 could also be allowed to move "backward" into the fixed feed tube 26, as described above. (This, of course, is for a screwdriving tool that operates as an "indexed on advance" tool.) FIG. 19 illustrates an example of such a positive latching mechanism.

Referring now to FIG. 19, another alternative embodiment, generally designated by the reference numeral 300, of the front portion of a fastener-driving tool of the present invention is depicted in an exploded view of some of its main internal components. In the front nosepiece area, a cam roller 370 is held in place in a slide body sub-assembly 334 by a cam screw 372. A cap screw 374 is used to hold the nosepiece 332 into its proper position in slide body sub-assembly 334. One of the positioning holes 338 is used to select the length of a collated, or a separate, fastener that will be used with the tool 300 at a particular time. The cap screw 374 also holds the nosepiece 332 and slide body sub-assembly 334 into relative position with respect to a slot in a movable feed tube 328.

A smaller coil spring 380 is illustrated as fitting inside the movable feed tube 328, and against a spring post 368 of a latch block structure 382. The latch block 382 also surrounds the outer dimensions of a second, larger coil spring 384, which itself fits into a fixed feed tube 326. The latch block 382 is held in place within the movable feed tube 328 by a set of screws 342, as illustrated in FIG. 19.

A slide tube latch 386 is held in place in the bottom of the movable feed tube 328 by a flat head screw 388, which retains the movable feed tube 328 and its contents within the body of the front portion 300 of the tool. The screw driving tool has another adjustment that controls how far the screw (or other type of rotatable fastener) will be driven into a solid object. This adjustment is controlled by a depth of drive knob 394, which enters a depth of drive block 396 through a depth of drive coil spring 398, which puts tension on the knob 394. A push nut 399 holds the depth of drive coil spring 398 in place.

The fixed feed tube 326 includes a set of "liners" that act as guides for the movable feed tube 328, in which feed tube 328 essentially slides along these guides 306 and 308, into the fixed feed tube 326. A set of push nuts 304 holds these guides 306, 308 in place. In one embodiment of the invention, there are two different types of guides at opposite corners, and the guides are typically made of nylon or some other type of plastic material that has relatively low friction and low wear characteristics. If the fixed feed tube is eliminated and its functions performed by the front housing portion 322, then the guides 306, 308 could be inserted into the housing 322, or the housing itself could act as the linear guides if the housing is made of a proper material.

FIG. 19 also illustrates some of the mechanical latching features of this embodiment 300 of the present invention. The latch block 382 has a latch lever 360 mounted thereto by a spring pin 362. Latch lever 360 is spring-loaded, by use of a leaf spring 364 that is mounted to an upper surface 366 of the latch block 382. When the front portion 300 of the fastener driving tool is in its extended, relaxed position, the latch lever 360 is pushed out by the leaf spring 364 through a "window" or opening 340 in the side wall of the movable feed tube 328. In this position, the latch lever 360 also extends into a "window" or opening 344 in the side wall of the fixed feed tube 326. (This arrangement can be seen in greater detail in the following views.)

When the front surface 336 of nosepiece 332 is pressed against a surface (typically a workpiece), the nosepiece 332 will tend to be pushed back into the movable feed tube 328. As that occurs, the cam roller 372 will move through its curved slot 373 in the side wall of the movable nosepiece 332. Moreover, the slide body sub-assembly 334 will move relative to the movable feed tube 328.

A linear actuator 350 is affixed or attached to the slide body sub-assembly 334, near one of its rear corners. Linear actuator 350 essentially is an extension (or a "protruding member"), and has a distal extension portion at 352, and a shorter, intermediate extension portion at 354. The further extension 352 serves as a guide to ensure that the slide body 334 and linear actuator 350 will be "aimed" at the proper target, and thus remain in a proper mechanical orientation during movement toward the movable feed tube 328. As will be seen in other views, this far distal extension 352 will tend to pass beneath a predetermined surface of the latch lever 360. However, the intermediate extension portion 354 of the linear actuator will, at its proper movement position, abut against the predetermined surface of the latch lever 360. When this occurs, the latch lever 360 will be pushed inward (i.e., toward the centerline of the slide body sub-assembly 334 and coil springs 380, 384), and this will also force the leaf spring 364 to be compressed.

As the latch lever 360 is pushed inward, it will clear the edge of the window 344, and once that occurs, the movable feed tube 328 will then be allowed to also move backwards with respect to the fixed feed tube 326. Until this has occurred, the latch lever 360 holds the movable feed tube 328 in a semi-fixed position with respect to the fixed feed tube 326, such that the movable feed tube 328 cannot be pushed backward with respect to the fixed feed tube 326. This is because the latch lever 360 is abutting the rear edge of the opening or window 344 in the fixed feed tube 326. This occurs during the "stage 1 " portion of the movement of the slide body sub-assembly 334, and this is similar to the other embodiments discussed above, in which it is not desired to allow the movable feed tube 328 to move with respect to the fixed feed tube 326 while a screw is being indexed into its drive position (when the tool is constructed as an "indexed on advance" configuration).

Once the latch lever 360 has been pivoted sufficiently so that its surface nk longer contacts the rear edge of the window 344, the movable feed tube 328 can then be moved with respect to the fixed feed tube 326, and then this allows the "stage 2" movement of the slide body sub-assembly 334 to occur. In general, the smaller coil spring 380 will be compressed during the stage 1 movement, and the larger coil spring 384 will either not be depressed at all, or will be depressed only slightly (this mainly depends on component tolerances of the entire tool assembly). However, once the latch lever 360 has been moved, and the movable feed tube 328 can move with respect to the fixed feed tube 326, this allows the larger coil spring 384 to also be compressed, which occurs during the stage 2 movement.

Figure 20:
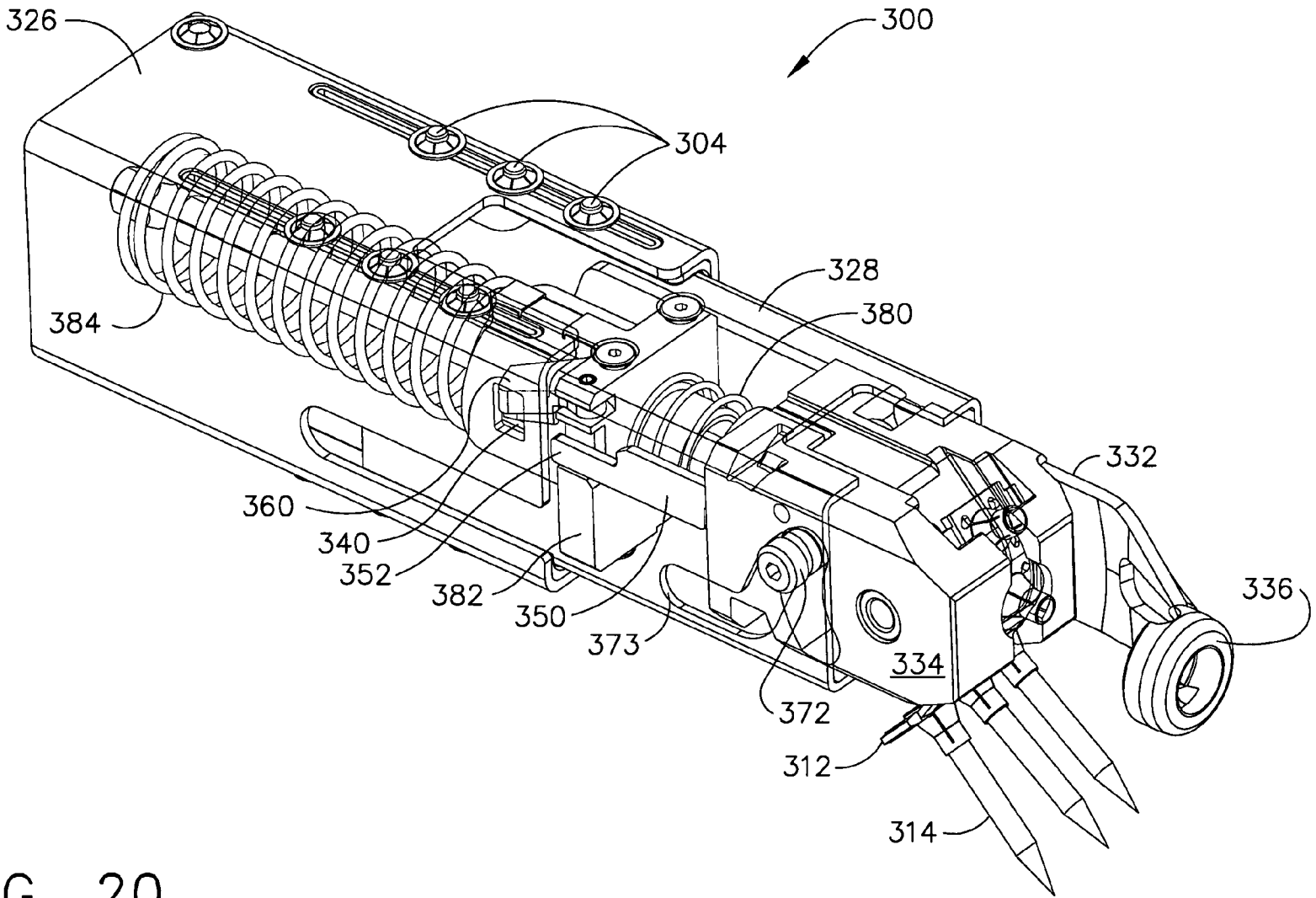
FIG. 20 is a perspective view of the front portion of the fastener driving tool of FIG. 19, illustrated in its "free," non-actuated state.

Referring now to FIG. 20, some of the details of the linear actuator 350 and the latch lever 360 are illustrated. FIG. 20 shows the front portion of the fastener driving tool 300 in its extended or "relaxed" position. A screw strip 312 is being brought in from below, and still has certain screws 314 attached thereto. There is no screw at the front-most or "drive" position, and this indicates that this construction is for an "indexed on advance" tool. In other words, one of these screws 314 will not be indexed to the drive position until it is time for the screw to be driven, which occurs while the nosepiece 332 is being "advanced" (which actually means it is being pushed against a workpiece surface).

The linear actuator 350 has its farthest extended portion 352 within a cut-out or opening along the side of the latch block 382. Since the latch block 382 is affixed to the movable feed tube 328, the slide body sub-assembly 334 can move (along with the linear actuator 350) through this cut-out or opening in the latch block 382.

In this relaxed position, the linear actuator 350 is not making contact with the latch lever 360, and thus latch lever 360 is allowed to be in its extended position, such that it has a surface that is abutting an edge of the window (or opening) 340 in the movable feed tube 328. As can be seen in FIG. 20, both the fixed feed tube 326 and the movable feed 328 have openings at this position (e.g., the two openings 340 and 344 are essentially aligned), and latch lever 360 will have a known (or predetermined) surface that will make contact against one or both of the edges for openings 340 and 344.

The latch lever 360 will be "allowed" to extend into these openings 340 and 344 because, when the front portion 300 is in its extended or relaxed position, latch lever 360 it is not being constrained by the linear actuator 350 and the leaf spring 364 can pivot the latch lever "outward" into the window (opening) 340. Also, when in this relaxed or extended position of the front portion 300, the smaller coil spring 380 is relaxed, as is the larger coil spring 384. Moreover, the cam follower 372 is in its initial position within its curved cam slot 373.

Figure 21:
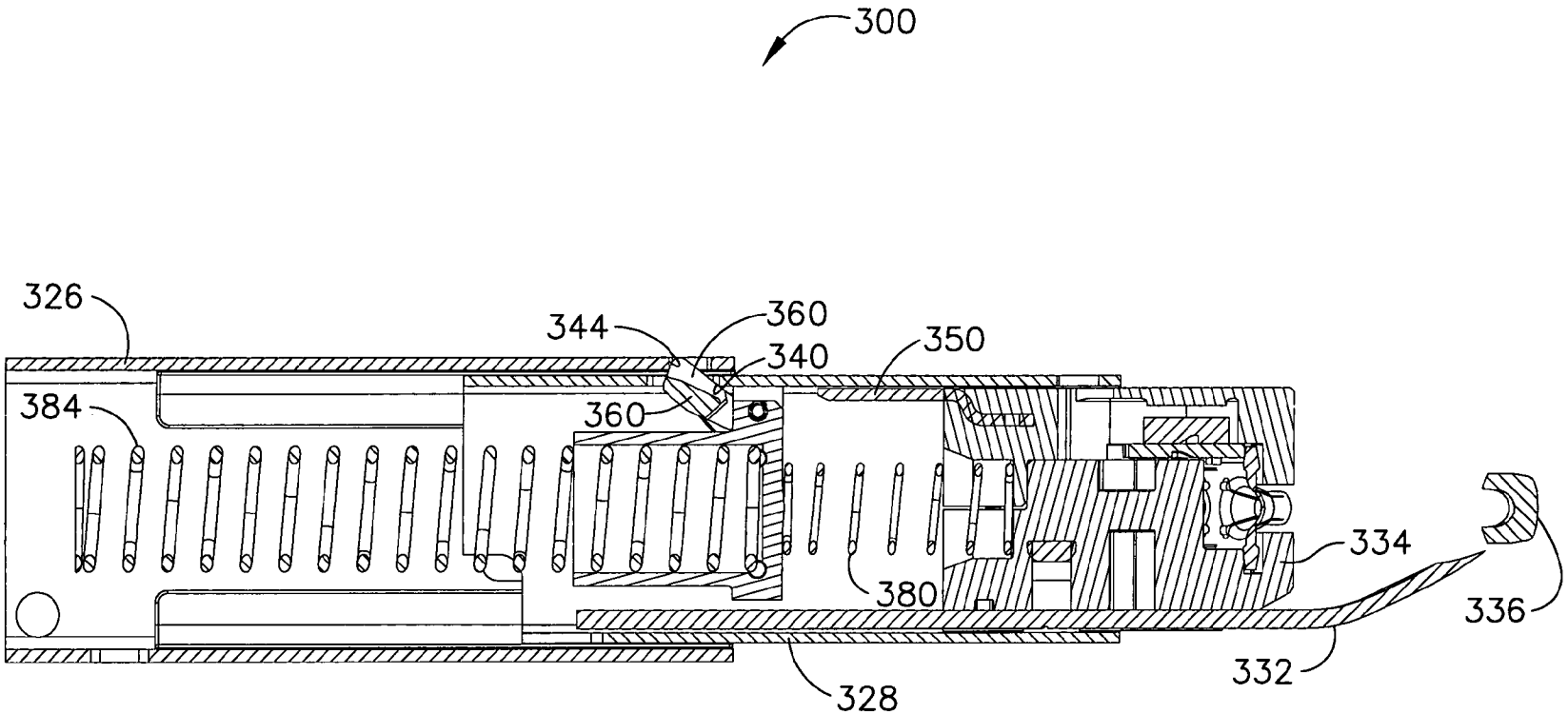
FIG. 21 is a bottom plan view of the tool of FIG. 19, illustrated in its free-non-actuated state.
Figure 22:
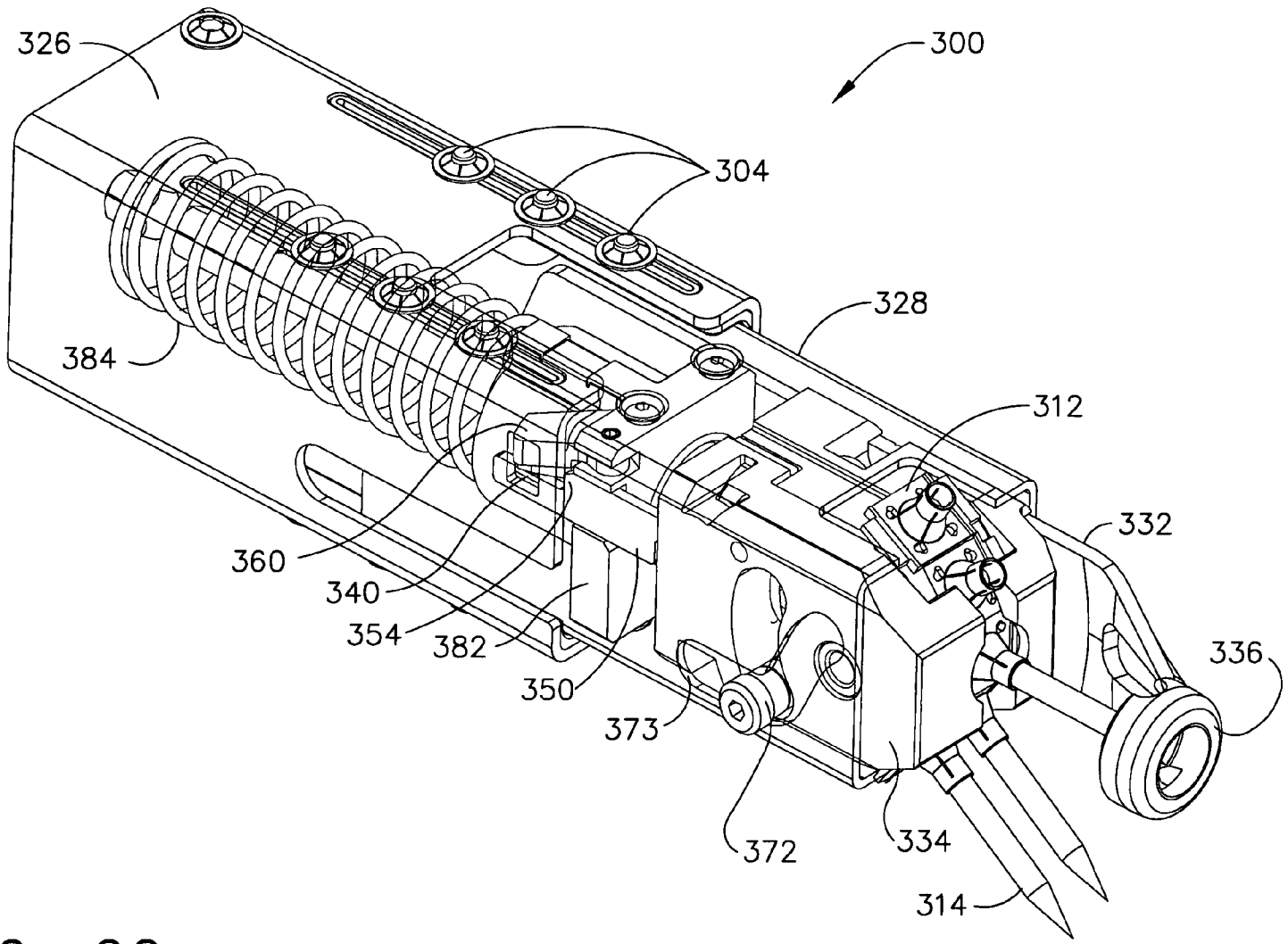
FIG. 22 is a perspective view of the front portion of the fastener driving tool of FIG. 19, illustrated in its stage 1 movement state.

Referring now to FIG. 21, the positions of the latch lever 360 with respect to the windows or openings 340 and 344 can be seen. The spring-loaded latch lever 360 is being pushed outward into its extended position, and it has a surface that is abutting the "back" edge of the window (opening) 344 in the fixed feed tube 326. This will prevent the movable feed tube 328 from moving with respect to the fixed feed tube 326 until the linear actuator 350 is moved into a position where it can make contact with the latch lever 360. (The fixed feed tube 328 acts as a stationary member of the housing 322, in this role.) Referring now to FIG. 22, the front portion 300 is now illustrated in a configuration where the slide body sub-assembly 334 has been pushed partially back through its travel when nosepiece 332 has had its front surface 336 pressed against a workpiece. In this configuration, a screw 314 has been indexed to its drive position, and this occurs because of the motion of the slide body sub-assembly 334, such that its indexing sprocket has moved the screw strip 312 in a manner to force a screw into that drive position. This occurs due to the camming action of the cam actuator 372 as it moves through its curved slot 373.

While that has been occurring, the movable feed tube 328 has not been allowed to move with respect to the fixed feed tube 326. However, the linear actuator 350 has now been forced back by the motion of the slide body sub-assembly 334 until its intermediate extension 354 has made contact with the latch lever 360. The view of FIG. 22 is showing the positions when the intermediate surface 354 first contacts the latch lever 360, which is before the latch lever 360 is pivoted and then clears the edge of the window (or opening) 340 in the movable feed tube 328. In this position, the slide body sub-assembly 334 has compressed the smaller coil spring 380 (barely visible in this view), however, the larger coil spring 384 has not been compressed. This of course is due to the fact that the movable feed tube 328 has not yet moved in relation to the fixed feed tube 326.

Figure 23:
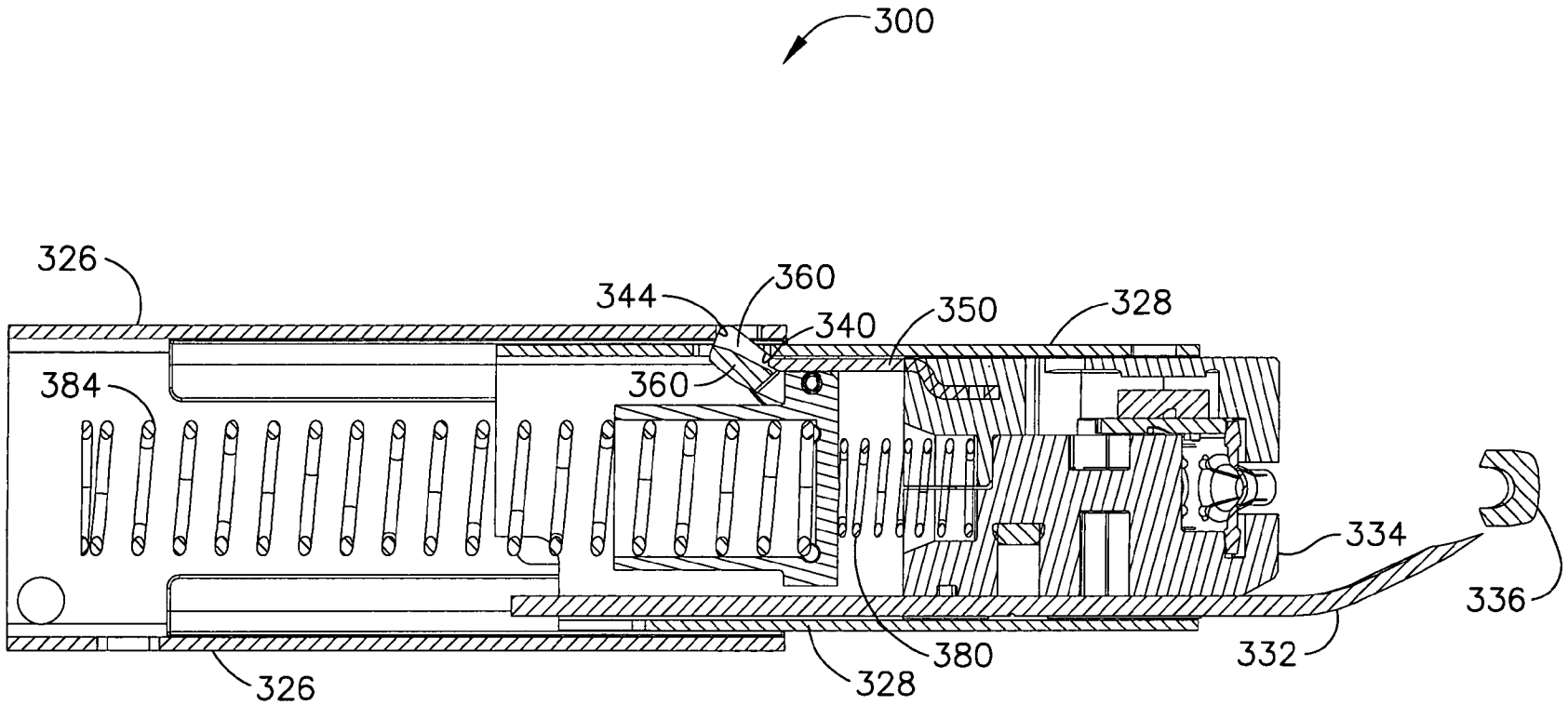
FIG. 23 is a bottom plan view of the tool of FIG. 19, illustrated in its stage 1 movement state.

Referring now to FIG. 23, the linear actuator 350 has its intermediate extension portion abutting the latch lever 360, which will soon be forced to pivot so that it clears the back surface of the opening (or window) 344 in the fixed feed tube 326. This has not yet occurred in the configuration of FIG. 23. As can be seen in this view, the smaller coil spring 380 has been partially or fully compressed, while the larger coil spring 384 remains uncompressed. A screw has been indexed to its drive position, but this is not visible on FIG. 23 because of the location of the section cut through the tool front portion 300. In this illustrated position, the front portion 300 has been moved entirely through its "stage 1" movement.

Figure 24:
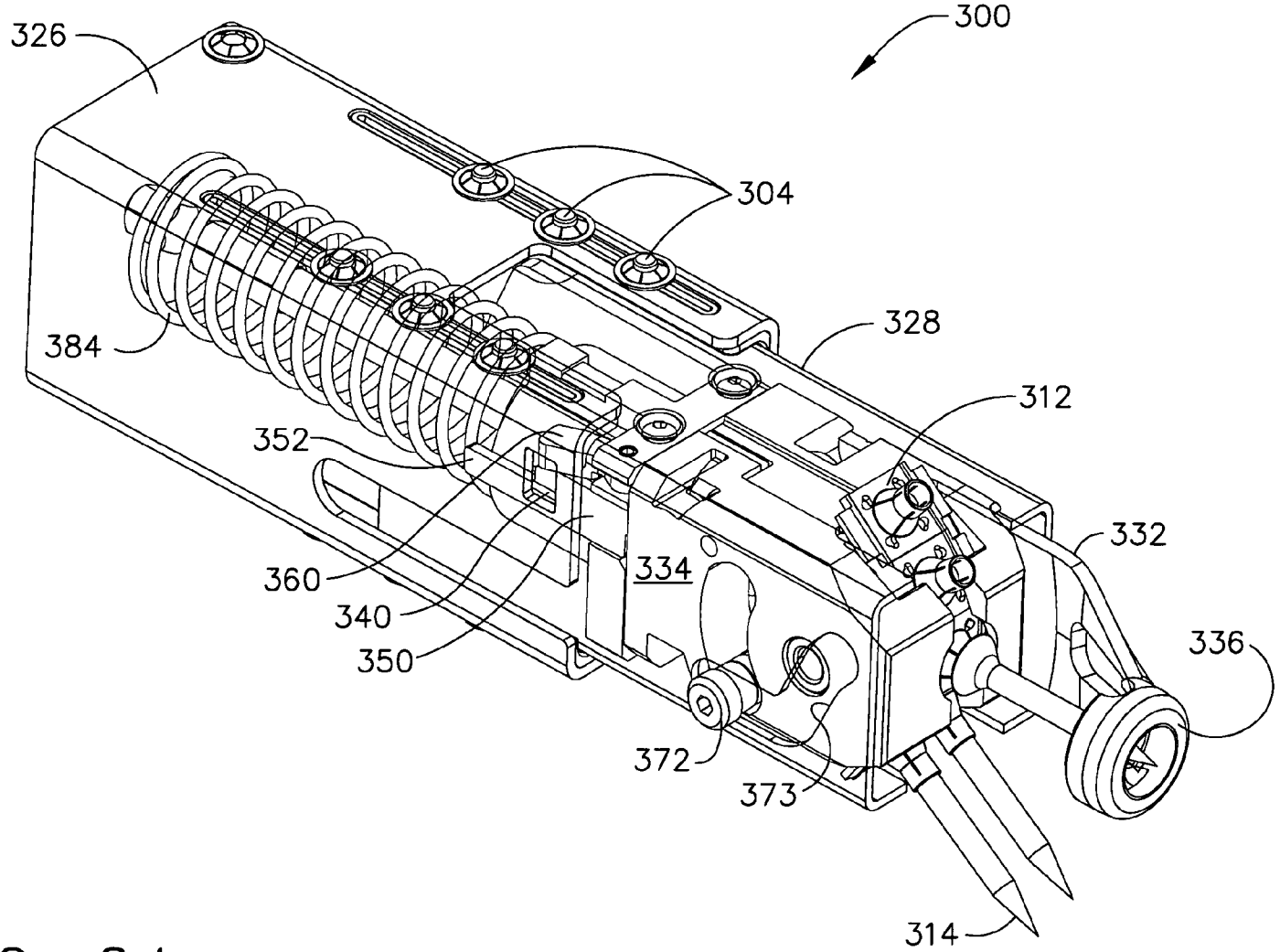
FIG. 24 is a perspective view of the front portion of the fastener driving tool of FIG. 19, illustrated in its stage 2 movement state.

Referring now to FIG. 24, the front portion 300 of the fastener driving tool is now moving through its stage 2 movement. This has been made possible by the movement of the slide body sub-assembly 334, which has caused the linear actuator 350 to press against the latch lever 360, and now in this pivoted position, the latch lever 360 is forced to clear the edge of the window (or opening) 344 in the fixed feed tube 326. Now that this has occurred, the larger coil spring 384 is being compressed, and the drive bit of the tool will force the screw or fastener 314 to be driven into the workpiece. The cam roller 372 is now in its "farthest backward" position in its curved camming slot 373. This all occurs during the "stage 2" movement of the slide body sub-assembly 334.

Figure 25:
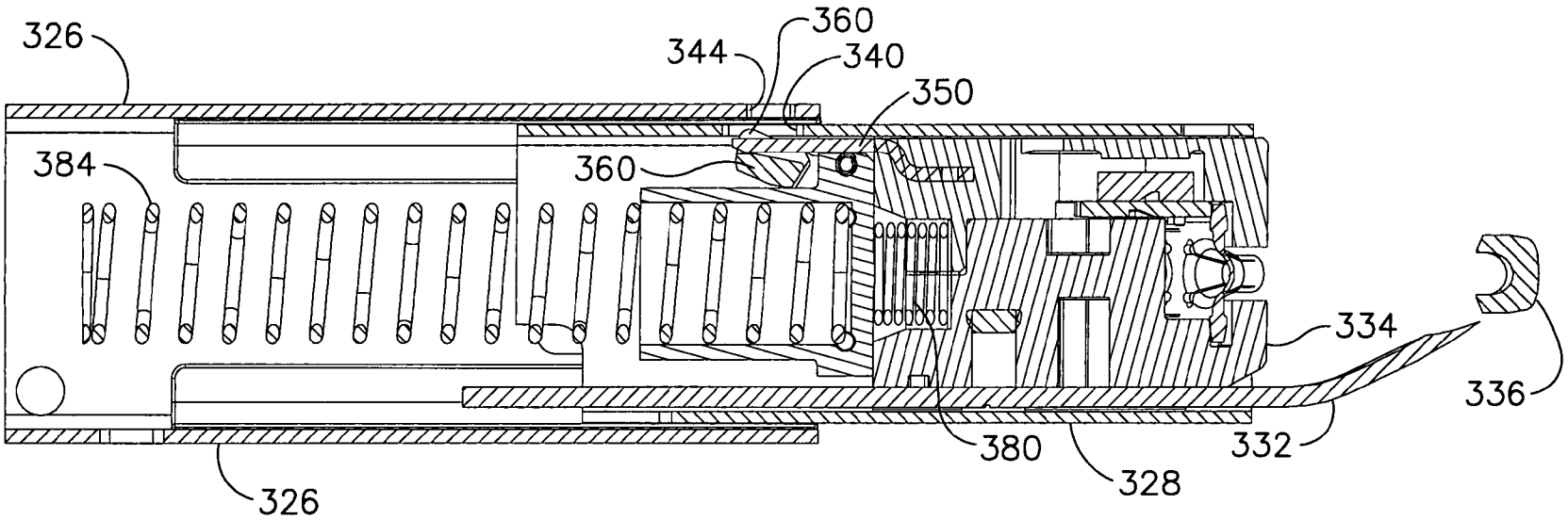
FIG. 25 is a bottom plan view of the tool of FIG. 19, illustrated in its stage 2 movement state.

Referring now to FIG. 25, it can be seen that the linear actuator 350 has pushed the latch lever 360 into a pivoted position so that it clears the edge of the window (or opening) 344 in the fixed feed tube 326. This pivoting of latch lever 360 allows the slide body sub-assembly 334 to be further pushed backward and to fully compress the larger coil spring 384 when the fastener has been completely driven into the workpiece.

Figure 26:
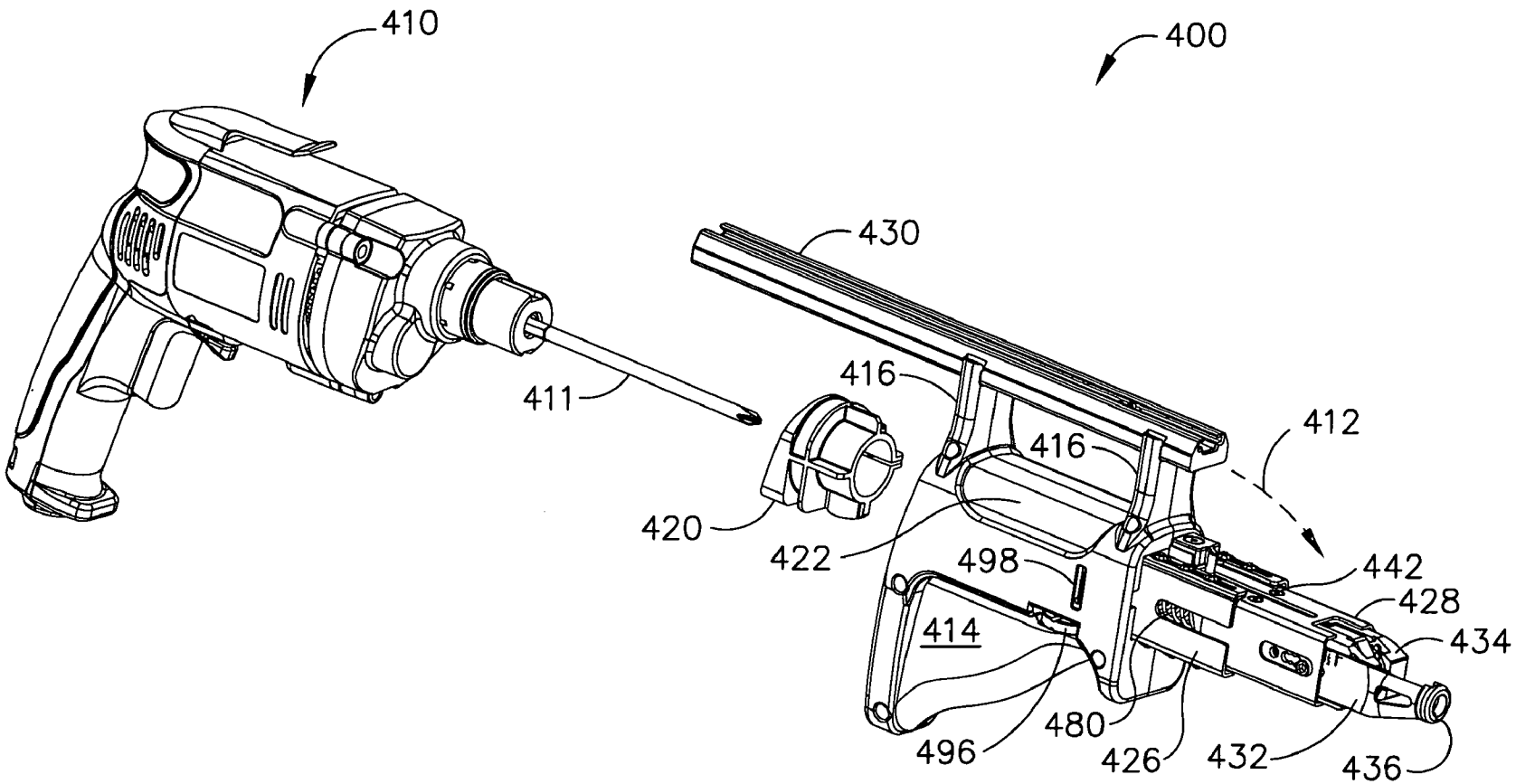
FIG. 26 is a perspective view of an attachment assembly that is to be fitted (using an adapter) to a separate screw gun, in which the attachment assembly includes a collapsible front end to provide the capability to drive screws almost directly into corners of walls, similar to the integral tools illustrated in FIGS. 1-25.

Referring now to FIG. 26, an attachment generally designated by the reference numeral 400 is provided that will be used with a separate screw gun 410. This type of separate screw gun 410 is available from many different manufacturers, including Senco Products, Inc. and DeWalt. The screw gun 410 has an output bit 411 that will drive the head of a screw or other type of rotatable fastener. In FIG. 26, the drive bit 411 has a Phillips front end.

The attachment 400 mates to the front end of the screw gun 410 by use of a separate adapter 420. Once the attachment 400 has been mounted to the screw gun 410, a collated strip of screws can be used with the screw gun 410, via this attachment 400. The collated strip is not illustrated in this view, but it would slide through a feed rail 430 that is mounted onto pedestals 416 that are mounted to the upper surface of its housing 422. On the lower surface of the housing 422 is a grip area 414, for placement of the user's hand. Attachment 400 includes a depth of drive adjustment knob 496, and also has a depth of drive indicator at 498. The housing 422 thus exhibits a "mating end" near the adapter 420, which receives the front end of the screw gun 410.

During operation, a collated strip of screws (or fasteners) would be fed through the guide rail (or feed rail) 430, from the rear toward the front of the tool attachment 400. As the collated scrip leaves the feed rail 430, it would travel the pathway indicated by the reference numeral 412. It would then enter a slide body sub-assembly 434 which would have an indexing sprocket that will control the positioning of the screws or fasteners that are part of the collated strip of fasteners.

Any one of the "front end" embodiments discussed above with respect to using a movable feed tube of the present invention could be provided in the attachment 400. In the view of FIG. 26, the front end embodiment illustrated in FIGS. 19-25 is used in attachment 400. Flat head screws 442 are used to hold a latch block (not seen in this view) in place within the movable feed tube 428. The hidden latch block will include a latch lever (also not seen in this view) that will operate in the same manner as the latch lever 360 illustrated on FIG. 19. When the front surface 436 of the nosepiece 432 is pressed against a workpiece, the slide body sub-assembly 434 will be pushed rearward with respect to the movable feed tube 428, and the (hidden) latch lever will prevent the movable feed tube 428 from moving with respect to the fixed feed tube 426 until the "stage 1" movement has been completed. Once that occurs, a linear actuator (also not seen in this view) will cause the hidden latch lever to pivot, and then allow the "stage 2" movement to occur by allowing the movable feed tube 428 to move with respect to the fixed feed tube 426.

The housing 422 exhibits an "actuation end" at the area in which the movable feed tube 428 is located. Housing 422 also includes an open interior space (not visible in FIG. 26) that contains portions of the fixed feed tube 426 and (upon actuation) portions of the movable feed tube 428. In addition, the open interior space of housing 422 allows an "external drive device," such as the bit 411 of the screw gun 410, to pass into and through the housing so that the bit may contact the screw head of the "lead screw" in the strip (not shown on FIG. 26) at the slide body sub-assembly 434, and thereby advance the screw into the workpiece, while also breaking this screw free from the strip.

It should be noted that the front portion of the attachment 400 is essentially an upside-down version of the front end assembly 300 of FIG. 19. The front nosepiece 432 is on the "right" side of the tool 410 in FIG. 26, whereas the nosepiece 332 was on the "left" side of the tool front-end 300 of FIG. 19. This arrangement is used because the collated strip of screws is being fed from above in the attachment embodiment 400, whereas the collated strip of screws was being fed from below in the embodiment 300 illustrated on FIG. 19.

Attachments for screw guns have been available for many years, including attachments made by Senco Products, Inc., and DuraSpin Products, LLC, the assignee of the present invention. However, the embodiment 400 is able to have its front portion fit much more tightly into a corner, by virtue of its movable feed tube 428. In other words, it will operate in the same manner as the earlier described embodiments, and will fit into a corner in the same fashion as illustrated by the tool 10 in FIG. 14.

Most of the above-described embodiments are based on a screwdriving tool that operates on an "indexed on advance" principle of operation. However, the principles of the present invention also apply to a tool which operates on an "indexed on return" principle of operation. In an "indexed on return" tool, a fastener (e.g., a screw) would be fed to the drive position 68 as the nosepiece 32 and slide body sub-assembly 34 are moving away from the main body of the tool 10, instead of when nosepiece 32 and slide body sub-assembly 34 are moving toward the tool main body. (These reference numerals relate to FIG. 13, for example.)

An "indexed on return" tool will not need to restrict the movements of the slide body sub-assembly 34 or the movable feed tube 28 while these parts are being pushed into the fixed feed tube 26, as the tool is being actuated to drive a fastener into a workpiece. The fastener/screw will already be in the drive position 68 (as illustrated in FIG. 4, for example) before the nose piece is pressed against the solid workpiece, so movements of the movable feed tube 28 need not be controlled at this time. At the time the tool is fully actuated, the movable feed tube 28 and the nose piece 32 will be fully collapsed (or "compressed") into the fixed feed tube 26, and the bit 66 will be pushed through the plastic strip 62 (see FIG. 12, for example).

However, upon release from the workpiece, the slide body sub-assembly 34 and nose piece 32 will begin moving away from the fixed feed tube 26, and the bit 66 of the tool will remain in contact with the plastic strip 62 until the slide body sub-assembly 34 moves far enough away from the tool body so that the strip 62 will "clear" the bit 66. During a first stage of movement (i.e., a "stage 1" movement) of the slide body sub-assembly/nose piece, it will be desirable for the movable feed tube 28 to also move away from the tool body/fixed feed tube 26. Typically, the movable feed tube 28 will not be allowed to continue movement past a predetermined maximum distance from the fixed feed tube 26 in this "indexed on return" tool. The stage 1 movement will end when the movable feed tube 28 reaches this predetermined maximum distance.

The movable feed tube must not be allowed to interfere with the "loading" of the "next" fastener from the collated strip 62 into the drive position 68, for the next actuation/operation of the tool as a fastener-driver/screwdriving tool. At some point it is desired for the movable feed tube 28 to become substantially stationary with respect to the tool's housing 22 and fixed feed tube 26 (e.g., at the above-noted predetermined maximum distance) while the slide body sub-assembly continues to move away from the tool housing/fixed feed tube, and thereby allow the indexing sprocket of the slide body sub-assembly to operate its camming action (e.g., like the cam screw 372 in the cam slot 373 in FIG. 20), which will index the next fastener/screw into that drive position 68. This can occur during a "stage 2" movement of the slide body sub-assembly, for an "indexed on return" tool. Of course, the camming action in such an "indexed on return" tool would work in the opposite sense of that illustrated in FIG. 20.

A set of springs can act as an inhibiting force against movement of the movable feed tube 28 during the stage 2 movement described in the previous paragraph. Alternatively, a mechanical latching mechanism could be used to positively prohibit movement of the movable feed tube 28 during this stage 2 movement. Such devices could be similar to the coil springs 80 and 84, described above, and/or to latching or detent mechanisms such as the leaf spring 90 of FIG. 12, or the latch lever 360 of FIG. 24, for example. Of course, in "indexed on return" tools, such mechanisms would operate in the opposite sense compared to those illustrated in these views.

An alternative way of describing the present invention as an indexed on return tool is to define "stage 1" movement as ending when the screw strip 62 clears the bit 66, as the slide body sub-assembly 34 (along with nose piece 32) moves away from the housing 20 and the fixed feed tube 26. The movable feed tube 28 also would likely be moving away from housing 20 and fixed feed tube 26 during this stage 1 movement of the slide body sub-assembly/nose piece.

Once the bit 66 has cleared strip 62, the indexing sprocket in slide body sub-assembly can be rotated to advance the "next" fastener/screw 64 to the drive position 68. The movable feed tube 28 needs to be prevented from substantial movement for a sufficient time to allow the slide body sub-assembly to continue moving away from the housing/fixed feed tube, or at least the movable feed tube 28 needs to be substantially slowed to allow a differential velocity to exist between itself and the slide body sub-assembly 34. This will allow the indexing sprocket to advance the next fastener/screw 64 to the drive position 68, using the camming action of the cam screw 372 in the cam slot 373 in FIG. 20, for example. These actions will occur during a "stage 2" movement of the slide body sub-assembly 34.

Note that the movable feed tube 28 can be held in place for the entire duration of the slide body sub-assembly's stage 2 movement, if desired, or the movable feed tube 28 could be allowed to have further movement after the sprocket has advanced the next fastener/screw 64 to the drive position 68. So long as some type of indexing mechanism is able to advance the next fastener/screw to the drive position in some form, the exact movements of the movable feed tube 28 and the slide body sub-assembly 34 do not need to be constrained to a specific pattern, while still falling within the principles of the present invention.

It will be understood that the terminology "feed tube" is one selected by the inventors for the relatively square structures seen in the views. When seen from the front of the tool 10, these structures are essentially hollow "tubes," but the tubes are not cylindrical. These structures are also sometimes referred to as "members" in other portions of this patent document, particularly in the claims. It will be understood that virtually any shape could be used for these structures, including a hollow cylinder, if desired, without departing from the principles of the present invention. The movable nose piece with slide body sub-assembly are also sometimes referred to as a "member" in other portions of this patent document, particularly in the claims.

One major reason for using both a "fixed" feed tube 26 and a "movable" feed tube 28 in the design of the tool 10 is so that the movable feed tube, perhaps along with the nose piece 32 and slide body sub-assembly 34, can be retrofitted into existing screw-driving tools sold by the assignees, Senco Products, Inc. or DuraSpin Products LLC. In the existing conventional tools, the movable portion (which chiefly consisted of the nose piece and slide body S/A) was installable into a non-movable feed tube that itself was affixed to the housing. The "fixed feed tube" 26 of the present invention is analogous to the earlier non-movable feed tubes of the earlier Senco/DuraSpin tools. It will be understood that a separate "fixed" feed tube would not always be necessary for the workings of the present invention (see FIG. 18, for example).

It will be understood that the principles of the present invention are applicable to many different types of fastener driving tools, including tools powered by AC electrical power (e.g., 120 VAC line power from an outlet), DC electrical power (e.g., from a battery or a solar panel), a pneumatic power source, or a hydraulic power source, for example. In other words, the prime mover device 52 could comprise an electric motor, a pneumatic motor, or a hydraulic motor, for example. In addition, the types of fasteners that can be driven in the manner of the present invention are not limited to screws, but could instead be nails or rivets, for example.

It will be understood that the term "collated screw sub-assembly" as used herein refers to a strip of screws that are temporarily mounted in a flexible strip of material that exhibits openings and other structures to hold the screws in place until they are needed. In many products, the flexible strip of material comprises plastic, but other materials could be used, if desired. The individual screws are advanced to a driving position in a screw driving tool (such as portable tool 10), and each screw is individually driven from the flexible strip by the tool when the tool is actuated.

As used herein, the term "proximal" can have a meaning of closely positioning one physical object with a second physical object, such that the two objects are perhaps adjacent to one another, although it is not necessarily required that there be no third object positioned therebetween. In the present invention, there may be instances in which a "male locating structure" is to be positioned "proximal" to a "female locating structure." In general, this could mean that the two male and female structures are to be physically abutting one another, or this could mean that they are "mated" to one another by way of a particular size and shape that essentially keeps one structure oriented in a predetermined direction and at an X-Y (e.g., horizontal and vertical) position with respect to one another, regardless as to whether the two male and female structures actually touch one another along a continuous surface. Or, two structures of any size and shape (whether male, female, or otherwise in shape) may be located somewhat near one another, regardless if they physically abut one another or not; such a relationship could still be termed "proximal." Moreover, the term "proximal" can also have a meaning that relates strictly to a single object, in which the single object may have two ends, and the "distal end" is the end that is positioned somewhat farther away from a subject point (or area) of reference, and the "proximal end" is the other end, which would be positioned somewhat closer to that same subject point (or area) of reference.

All documents cited in the Detailed Description of the Invention are, in relevant part, incorporated herein by reference; the citation of any document is not to be construed as an admission that it is prior art with respect to the present invention.

The foregoing description of a preferred embodiment of the invention has been presented for purposes of illustration and description. It is not intended to be exhaustive or to limit the invention to the precise form disclosed. Any examples described or illustrated herein are intended as non-limiting examples, and many modifications or variations of the examples, or of the preferred embodiment(s), are possible in light of the above teachings, without departing from the spirit and scope of the present invention. The embodiment(s) was chosen and described in order to illustrate the principles of the invention and its practical application to thereby enable one of ordinary skill in the art to utilize the invention in various embodiments and with various modifications as are suited to particular uses contemplated. It is intended to cover in the appended claims all such changes and modifications that are within the scope of this invention.

The invention claimed is:

1. A portable fastener-driving tool, comprising:

(a) an elongated housing containing a prime mover device, said housing having a first end and a second end; (b) a first member extending from said first end of the housing, said first member having a third end and a fourth end, in a first, non-actuated state said third end being distal from said first end of the housing and said fourth end being proximal to said first end of the housing; (c) a second member extending from said third end of the first member, said second member having a fifth end and a sixth end, in said first, non-actuated state said fifth end being distal from said third end of the first member and said sixth end being proximal to said third end of the first member; (d) an intermediate drive device that extends between said prime mover device and said second member;

wherein:

(e) said first member is movable with respect to said housing;

(f) said second member is movable with respect to said first member;

(g) when in said first, non-actuated state, said first member extends past said first end of the housing such that said third end of the first member is positioned substantially at a first predetermined distance from said first end of the housing, and said second member extends past said third end of the first member such that said fifth end of the second member is positioned substantially at a second predetermined distance from said third end of the first member;

(h) when in a second state, as said second member is pushed against a solid object, said first member continues to extend past said first end of the housing substantially at said first predetermined distance between said first end of the housing and said third end of the first member, but said second member moves toward said housing and toward said first member, such that said fifth end of the second member becomes positioned from said third end of the first member at a distance less than said second predetermined distance;

(i) when in an third state, as said second member continues to be pushed against said solid object, both said second member and said first member move toward said housing, such that said third end of the first member becomes positioned from said first end of the housing at a distance less than said first predetermined distance;

(j) said second member includes a nose piece member that makes contact with said solid object to cause said second member to be moved toward said housing and toward said first member during a first stage of movement, and to cause said second member to continue to be moved toward said housing during a second stage of movement;

(k) a fastener is moved into a drive position during said first stage of movement; and (l) said fastener is driven into said solid object by said prime mover device and said intermediate drive device during said second stage of movement;

and further comprising a spring-loaded, pivotable latch lever that:

(m) when said first member and said second member are in their non-actuated states, a first predetermined surface of said latch lever presses against an edge of an opening in a stationary member of said housing, and thereby prevents substantial movement of said first member toward said housing;

(n) until the first stage movement of said second member is substantially completed, said first predetermined surface of the latch lever continues to press against said edge of the opening in the stationary member of said housing, and continues to prevent substantial movement of said first member toward said housing; and (o) once said first stage movement of said second member is substantially completed, a protruding member that is attached to said second member abuts a second predetermined surface of said latch lever and forces the latch lever to pivot in a manner that causes said first predetermined surface of the latch lever to clear said edge of the opening in the stationary member of said housing, which now allows said first member to move toward said housing.

2. The portable fastener-driving tool as recited in claim 1, wherein said second member includes a fastener indexer that receives a collated strip of fasteners and moves an individual one of said fasteners of the collated strip to said drive position.

3. The portable fastener-driving tool as recited in claim 1, wherein said housing is in slidable mechanical communication with said first member, and said first member is in slidable mechanical communication with said second member.

4. The portable fastener-driving tool as recited in claim 1, wherein: (a) said first member is of a substantially hollow construction with a first interior region, and allows said second member to collapse into said first interior region during said first stage of movement; and (b) said housing is of a substantially hollow construction with a second interior region, and allows said first member to collapse into said second interior region during said second stage of movement.

5. The portable fastener-driving tool as recited in claim 4, wherein: (a) said prime mover device comprises an electric motor positioned substantially within said second interior region; and (b) said intermediate drive device comprises a gear reduction and clutch sub-assembly positioned substantially within said second interior region.

6. The portable fastener-driving tool as recited in claim 4, wherein said intermediate drive device comprises a drive bit that extends substantially through said first interior region and engages said fastener at said drive position.

7. A portable fastener-driving tool, comprising:

(a) a housing containing a prime mover device and an intermediate drive device, said housing having an actuation end; (b) a movable first member extending from said actuation end of the housing, said first member having a first distal end; and (c) a movable second member extending from said first distal end of the first member, said second member having a second distal end;

wherein:

(d) in a first, non-actuated state, said second distal end of the second member is substantially at a predetermined first distance with respect to said actuation end of the housing; and (e) when said tool is actuated by a sufficient force against said second distal end of the second member, said second member begins to move relative to said housing, and:

(i) said second member travels through a first stage of movement from said predetermined first distance, and moves relative to said first member, while said first member is substantially prevented by a first mechanism from moving relative to said housing until said second distal end of the second member reaches substantially a predetermined second distance with respect to said actuation end of the housing; and (ii) then said second member travels through a second stage of movement from said predetermined first distance and past said predetermined second distance, and said first member moves relative to said housing while overcoming said first mechanism, until said second distal end of the second member reaches substantially a predetermined third distance with respect to said actuation end of the housing, which substantially completes the movement of said second member;

wherein said predetermined first distance is greater than said predetermined second distance, and said predetermined second distance is greater than said predetermined third distance;

and further comprising a spring-loaded, pivotable latch lever that:

(f) when said first member and said second member are in their non-actuated states, a first predetermined surface of said latch lever presses against an edge of an opening in a stationary member of said housing, and thereby prevents substantial movement of said first member toward said housing;

(g) until the first stage movement of said second member is substantially completed, said first predetermined surface of the latch lever continues to press against said edge of the opening in the stationary member of said housing, and continues to prevent substantial movement of said first member toward said housing; and (h) once said first stage movement of said second member is substantially completed, a protruding member that is attached to said second member abuts a second predetermined surface of said latch lever and forces the latch lever to pivot in a manner that causes said first predetermined surface of the latch lever to clear said edge of the opening in the stationary member of said housing, which now allows said first member to move toward said housing.

8. The portable fastener-driving tool as recited in claim 7, wherein:

(a) a fastener is moved into a drive position during said first stage of movement; and (b) said fastener is driven into a solid object by said prime mover device and said intermediate drive device during said second stage of movement.

9. The portable fastener-driving tool as recited in claim 7, wherein said second member includes a fastener indexer that receives a collated strip of fasteners and moves an individual one of said fasteners of the collated strip to a drive position.

10. The portable fastener-driving tool as recited in claim 7, wherein said housing is in slidable mechanical communication with said first member, and said first member is in slidable mechanical communication with said second member.

11. The portable fastener-driving tool as recited in claim 7, wherein: (a) said first member is of a substantially hollow construction with a first interior region, and allows said second member to collapse into said first interior region during said first stage of movement; and (b) said housing is of a substantially hollow construction with a second interior region, and allows said first member to collapse into said second interior region during said second stage of movement.

12. The portable fastener-driving tool as recited in claim 11, wherein: (a) said prime mover device comprises an electric motor positioned substantially within said second interior region; and (b) said intermediate drive device comprises a gear reduction and clutch sub-assembly positioned substantially within said second interior region.

13. The portable fastener-driving tool as recited in claim 11, wherein said intermediate drive device comprises a drive bit that extends substantially through said first interior region and engages a fastener at a drive position.

14. A portable fastener-driving tool, comprising:

(a) a housing containing a prime mover device, said housing having an actuation end;

(b) a movable first member extending from said actuation end of the housing, said first member having a first distal end;

(c) a movable second member extending from said first distal end of the first member, said second member having a second distal end;

(d) a first spring device that tends to oppose movement between said first member and said housing; and (e) a second spring device that tends to oppose movement between said second member and said first member;

wherein, when said tool is actuated by a sufficient force against the second distal end of the second member:

(f) during a first stage of actuation, said second member moves relative to said first member, while being opposed by said second spring device, but said first member does not substantially move relative to said housing due to said first spring device; and (g) during a second stage of actuation, said first member moves relative to said housing, while being opposed by said first spring device;

and further comprising a spring-loaded, pivotable latch lever that:

(h) when said first member and said second member are in their non-actuated states, a first predetermined surface of said latch lever presses against an edge of an opening in a stationary member of said housing, and thereby prevents substantial movement of said first member toward said housing;

(i) until the first stage of actuation of said second member is substantially completed, said first predetermined surface of the latch lever continues to press against said edge of the opening in the stationary member of said housing, and continues to prevent substantial movement of said first member toward said housing; and (j) once said first stage of actuation of said second member is substantially completed, a protruding member that is attached to said second member abuts a second predetermined surface of said latch lever and forces the latch lever to pivot in a manner that causes said first predetermined surface of the latch lever to clear said edge of the opening in the stationary member of said housing, which now allows said first member to move toward said housing.

15. The portable fastener-driving tool as recited in claim 14, wherein:

(a) a fastener is moved into a drive position during said first stage of actuation; and (b) said fastener is driven into a solid object by said prime mover device and an intermediate drive device during said second stage of actuation.

16. The portable fastener-driving tool as recited in claim 14, wherein said second member includes a fastener indexer that receives a collated strip of fasteners and moves an individual one of said fasteners of the collated strip to a drive position.

17. The portable fastener-driving tool as recited in claim 14, wherein said housing is in slidable mechanical communication with said first member, and said first member is in slidable mechanical communication with said second member.

18. The portable fastener-driving tool as recited in claim 14, wherein: (a) said first member is of a substantially hollow construction with a first interior region, and allows said second member to collapse into said first interior region during said first stage of actuation; and (b) said housing is of a substantially hollow construction with a second interior region, and allows said first member to collapse into said second interior region during said second stage of actuation.

19. The portable fastener-driving tool as recited in claim 18, wherein: said prime mover device comprises an electric motor positioned substantially within said second interior region.

20. The portable fastener-driving tool as recited in claim 18, further comprising a drive bit that extends substantially through said first interior region and engages a fastener at a drive position.

* * * * *